US011278142B2

(12) United States Patent
Sekura

(10) Patent No.: US 11,278,142 B2
(45) Date of Patent: Mar. 22, 2022

(54) HANGER

(71) Applicant: SEKURA CORPORATION, Hasuda (JP)

(72) Inventor: Norio Sekura, Hasuda (JP)

(73) Assignee: SEKURA CORPORATION, Saitama (JP)

( * ) Notice: Subject to any disclaimer, the term of this patent is extended or adjusted under 35 U.S.C. 154(b) by 203 days.

(21) Appl. No.: 16/762,188

(22) PCT Filed: Mar. 5, 2019

(86) PCT No.: PCT/JP2019/008643
§ 371 (c)(1),
(2) Date: May 7, 2020

(87) PCT Pub. No.: WO2019/202863
PCT Pub. Date: Oct. 24, 2019

(65) Prior Publication Data

US 2020/0359818 A1 Nov. 19, 2020

(30) Foreign Application Priority Data

Apr. 16, 2018 (JP) ..... JP2018-078503
Sep. 19, 2018 (JP) ..... JP2018-174945
Feb. 8, 2019 (JP) ..... JP2019-021733

(51) Int. Cl.
*A47G 25/40* (2006.01)

(52) U.S. Cl.
CPC ..... *A47G 25/4023* (2013.01)

(58) Field of Classification Search
CPC ..... A47G 25/4023; A47G 25/4015; A47G 25/14–48; A47G 25/4046; A47G 25/4053; A47G 25/4092
See application file for complete search history.

(56) References Cited

U.S. PATENT DOCUMENTS 1,676,936 A * 7/1928 Trevino ..... A47G 25/4023 223/94
1,970,943 A * 8/1934 Morris ..... A47G 25/10 223/94

(Continued)

FOREIGN PATENT DOCUMENTS

CN 103417093 A 12/2013
CN 103976624 A 8/2014

(Continued)

OTHER PUBLICATIONS

Office Action dated May 26, 2021, issued in counterpart CN application No. 201980005198.3, with English translation. (22 pages).

(Continued)

*Primary Examiner* — Ismael Izaguirre

(74) *Attorney, Agent, or Firm* — Westerman, Hattori, Daniels & Adrian, LLP

(57) ABSTRACT

To provide a hanger which can be manufactured inexpensively, and which can be fitted to clothing with one hand and one touch. A hanger 2 is provided with: an operating portion 30 provided with a hook 31, a branching portion 32 which is disposed at a base of the hook 31 and which is divided into a fork to the front side and the rear side in a front view, knobs 34 each having an insertion hole 33A in a central part thereof and disposed at lower ends of the branching portion 32, and a pair of projecting portions 35 provided on opposing surfaces of the knobs.

16 Claims, 26 Drawing Sheets

(56) References Cited

U.S. PATENT DOCUMENTS

| | | | | | |
|---|---|---|---|---|---|
| 2,413,221 | A * | 12/1946 | Elston | A47G 25/4023 | 223/89 |
| 2,719,658 | A * | 10/1955 | Bayliss | A47G 25/40 | 223/94 |
| 3,705,673 | A * | 12/1972 | Mohammar | A47G 25/4023 | 223/94 |
| 3,858,770 | A * | 1/1975 | Murray | A47G 25/4023 | 223/94 |
| 5,397,037 | A | 3/1995 | Ozawa | | |
| 2014/0158724 | A1 * | 6/2014 | Merandi | A47G 25/32 | 223/85 |

FOREIGN PATENT DOCUMENTS

| | | | |
|---|---|---|---|
| CN | 207041391 | U | 2/2018 |
| DE | 3830474 | A1 * | 3/1990 |
| JP | 52-159724 | U | 12/1977 |
| JP | 2514716 | Y2 | 10/1996 |
| WO | 2018/150851 | A1 | 8/2018 |
| WO | 2018/151207 | A1 | 8/2018 |

OTHER PUBLICATIONS

Extended (Supplementary) European Search Report dated Jun. 8, 2021, issued in counterpad EP application No. 19788432.3. (5 pages).

International Search Report dated Apr. 16, 2019, issued in counterpart application No. PCT/JP2019/008643 (2 pages).

* cited by examiner

HANGER

TECHNICAL FIELD

The present invention relates to a hanger.

BACKGROUND ART

In a case where a round neck t-shirt or the like is displayed on a prior hanger in a clothing store or the like, the hanger should be inserted from the lower portion of the t-shirt, which takes man-hours and time.

In addition, when the hanger is used, the clothing cannot be hung on the hanger unless the hanger and the clothing are respectively held with hands. In addition, when the clothing is removed from the hanger, either the clothing or the hanger falls unless the hanger and the clothing are respectively held with hands. Accordingly, there is a need to open and close the hanger with one hand and one touch. In addition, more convenience will be achieved if the hanger is opened and closed on a clothesline or a hanger rack pipe without being held with a hand.

Proposed in this regard is a hanger in which an arm base is provided with a circular arc-shaped groove portion having a recess positioned above when an arm is open, a pin fitting into the recess is biased upward by a spring, and the pin regulates arm closing by fitting into the recess when the arm is open (see, for example, Patent Document 1.).

However, there is a need to provide an elastic body as a separate member for this technique, and thus an increase in manufacturing cost results from assembly and parts costs.

Also proposed is a hanger in which a plate-shaped operating plate is provided below a hook, the operating plate is provided with a vertically elongated groove and a pair of L-shaped grooves in which vertical grooves bent downward are connected to the distal ends of lateral grooves laterally extending to the right and left of the vertically elongated groove, a pin is inserted through holes in the bases of a pair of arms and the vertically elongated groove of the operating plate, and a projection provided in the vicinity of the hole in the base of each arm is fitted in the L-shaped groove of the operating plate (see, for example, Patent Document 2.). This hanger is to open the arm by pushing down the hook.

However, this technique has a problem in that the arm is not opened with one hand and one touch when the hook is pushed down so that the arm that is closed is opened. This is because each projection is positioned in the vicinity of the vertically elongated groove in a state where the arm is closed. When a downward force is applied in this state, the force in the direction to open the arm, that is, the horizontal component force is very small. Accordingly, there is a need to apply a strong force in such a way that the horizontal component force required for arm opening becomes sufficiently large or increase the horizontal component force by opening the arm to some extent in order to open the arm. Accordingly, the arm cannot be opened with one hand and one touch.

In other words, in the hanger of Patent Document 2, a pivot 5 becomes a fulcrum, a guide projection 8 becomes a force point, and the distal end of a hanger arm 1 becomes a point of action. In this case, the distance between the fulcrum and the force point is too short compared to the distance between the fulcrum and the point of action. Accordingly, a large force is required to open the hanger arm 1.

CITATION LIST

Patent Document

Patent Document 1: Japanese Utility Model Registration No. 2,514,716

Patent Document 2: JP-UM-A-52-159724

SUMMARY OF THE INVENTION

Technical Problem

A problem to be solved by the invention is to provide a hanger which can be manufactured inexpensively, and which can be fitted to clothing with one hand and one touch.

Solution to Problem

In order to solve the above problems, the invention provides a hanger including: an operating portion provided with a hook, a branching portion which is disposed at a base of the hook and which is divided into a fork to the front side and the rear side in a front view, knobs each having an insertion hole in a central part thereof and disposed at lower ends of the branching portion, and a pair of projecting portions provided on opposing surfaces of the knobs; a main body portion including a main slit which extends in the vertical direction and into which the projecting portions fit, and a pair of side slits which are provided on both sides of the main slit, extend toward the main slit, change to a downward orientation while curving ahead of the main slit, and then extend along the main slit; a pair of arms each provided with a base portion having a pin hole in the vicinity of a distal end thereof, and a movement pin which is provided in the base portion and which is inserted through the corresponding side slit; and a pin inserted through the insertion holes and the pin holes.

Advantageous Effects of the Invention

According to the invention, it is possible to provide a hanger which can be manufactured inexpensively, and which can be fitted to clothing with one hand and one touch.

MODE FOR CARRYING OUT THE INVENTION

Hereinafter, a hanger 1 according to an embodiment of the invention will be described with reference to the drawings.

(Embodiment of Prior Example)

Figure 1:
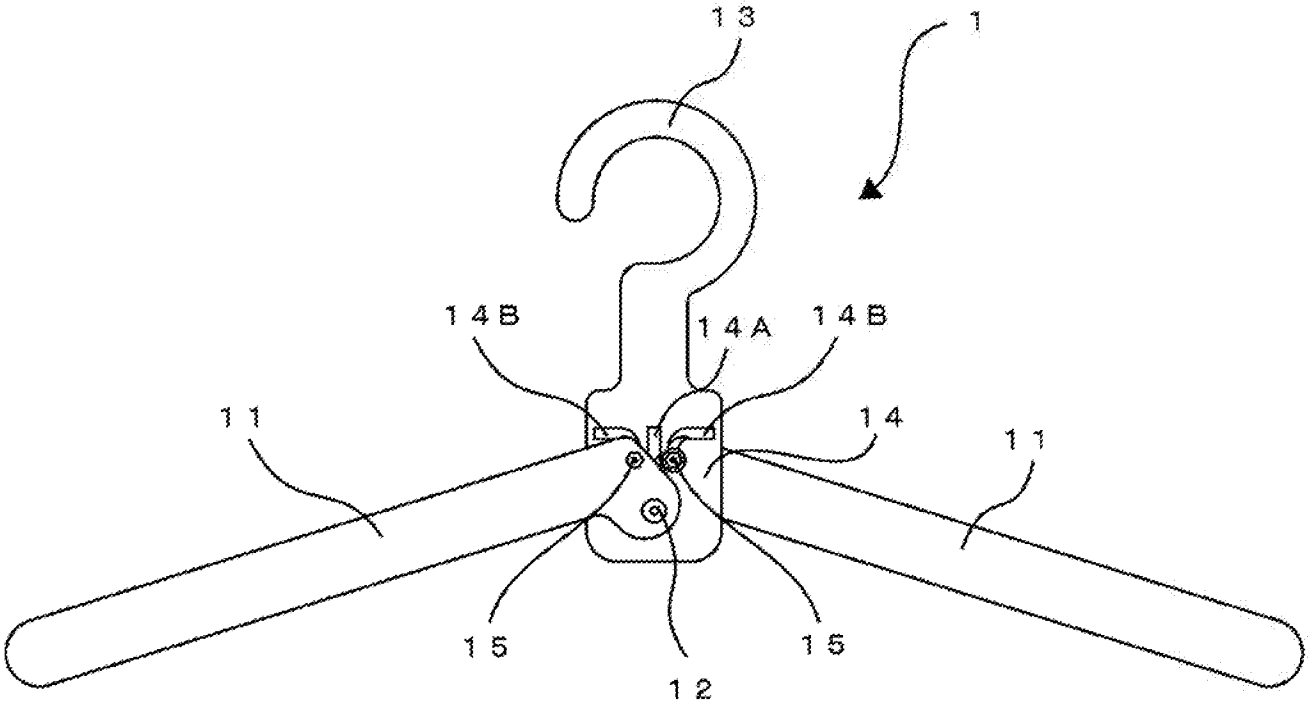
FIG. 1 is a front view illustrating a state where an arm of a hanger of an embodiment of a prior example is open.
Figure 2:
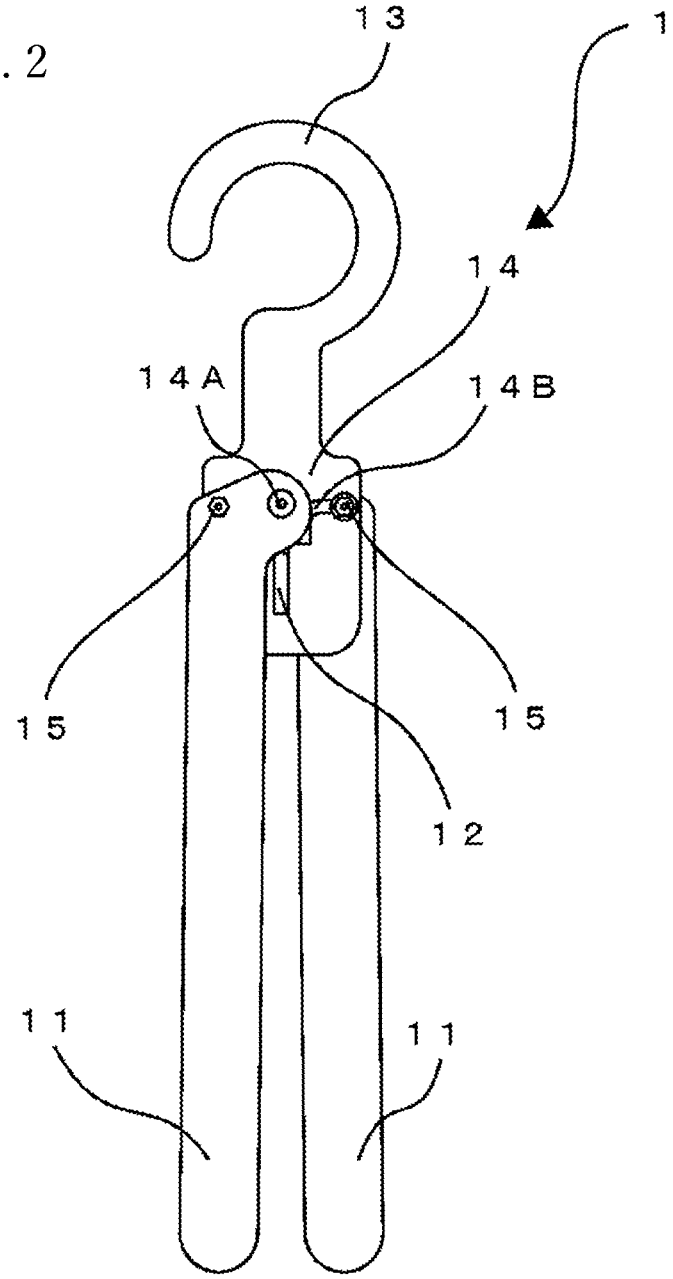
FIG. 2 is a front view illustrating a state where the arm of the hanger of the embodiment of the prior example is closed.
Figure 3:
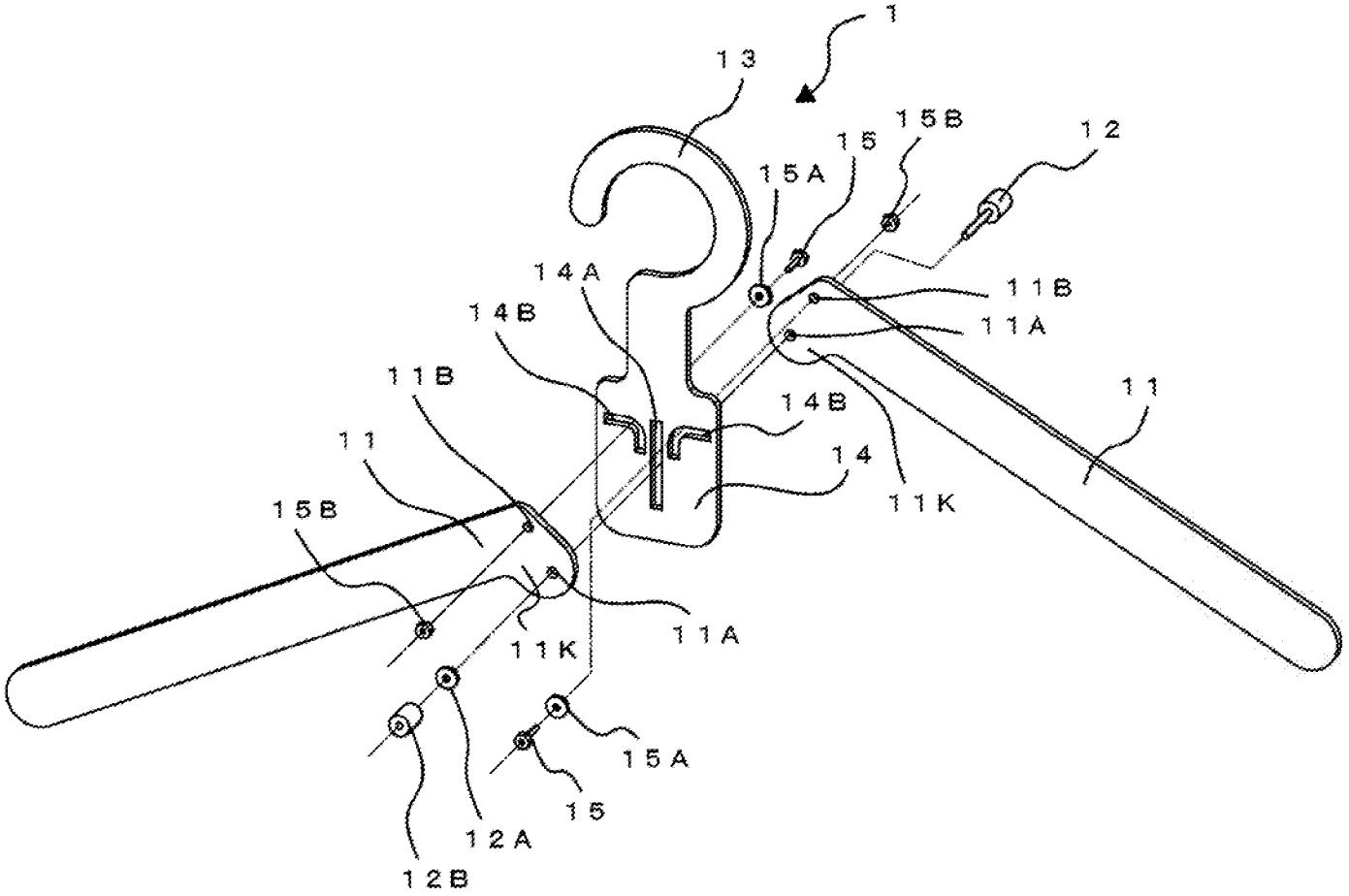
FIG. 3 is an exploded perspective view of the hanger of the embodiment of the prior example.

FIG. 1 is a front view illustrating a state where an arm 11 of the hanger 1 of the present embodiment is open, FIG. 2 is a front view illustrating a state where the arm 11 of the hanger 1 is closed, and FIG. 3 is an exploded perspective view of the hanger 1.

As illustrated in FIGS. 1 to 3, the hanger 1 is provided with a hook 13, a main body portion 14, and a pair of the arms 11.

The main body portion 14 is provided in the lower end portion of the hook 13 in the front view in FIG. 1 (the vertical, right-left, longitudinal, and lateral directions in the following description are based on the front view in FIG. 1). The main body portion 14 is provided with a main slit 14A in the central portion of the main body portion, which is a through groove extending downward from above in the main body portion 14, and a pair of side slits 14B provided on both sides of the main slit 14A.

The side slits 14B extend from the vicinity of the right and left end portions of the main body portion 14 toward the main slit 14A at positions corresponding to the upper end portion of the main slit 14A, change to a downward orientation while curving ahead of the main slit 14A, and extend to approximately half of the longitudinal length of the main slit 14A.

The part of the side slit 14B that extends along the main slit 14A from the lower end of the curving part extends downward in parallel with the main slit 14A. The part of the side slit 14B that extends along the main slit 14A may not be parallel with the main slit 14A and may extend downward and outward or downward and inward insofar as the part deviates from the circumference of a circle having the curving part of the side slit 14B as an arc.

The main slit 14A and the two side slits 14B are provided in such a way that the upper end portion of the main slit 14A and the upper end portions of the two side slits 14B substantially line up in the lateral direction.

Desirably, the pair of arms 11 are formed in the same shape for a decrease in the number of mold types. The arm 11 has a bent portion 11K bent downward in the end portion of the arm 11 that is in the direction of the main body portion 14 and is provided with a main hole 11A, which is a through hole provided in the distal end portion of the bent portion 11K, and a side hole 11B, which is a through hole provided in the base of the bent portion 11K. The main hole 11A and the side hole 11B are disposed in such a way that a straight line interconnecting the main hole 11A and the side hole 11B intersects with the axis of the arm 11, that is, a straight line extending in the direction in which the arm 11 extends.

The specific shapes of the pair of arms 11 may be different from each other insofar as the pair of arms 11 have a common basic part such as the length of the arm 11 and the angle formed by the upper end portion when the arm 11 is open.

The main body portion 14 and the pair of arms 11 are pivotably locked by a main pin 12 being inserted through the main hole 11A and the main slit 14A and a side pin 15 being inserted through the side hole 11B and the side slit 14B.

A main washer 12A and a main nut 12B are attached to the main pin 12. The main pin 12 and the main nut 12B have a knob portion extending in an axial direction. The knob portion protrudes in the axial direction of the main pin 12 from the surface of the main body portion 14 to the extent that a finger touches the knob portion.

A side washer 15A and a side nut 15B are attached to the side pin 15.

It should be noted that the main washer 12A and the side washer 15A can be omitted. In this case, pins shaped so as not to be separated when fitted can be used as the main pin 12 and the side pin 15. In addition, the side pin 15 may be formed integrally with the arm 11.

The main body portion 14 may be positioned between the pair of arms 11 or may be positioned outside the pair of arms 11.

As described above, the hanger 1 of the embodiment of the prior example is provided with the hook 13, the main body portion 14 provided below the hook 13 and having the vertically extending main slit 14A and the pair of side slits 14B, which are provided on both sides of the main slit 14A, laterally extend toward the main slit 14A, change to the downward orientation while curving ahead of the main slit 14A, and then extend along the main slit 14A, the pair of arms 11 having the bent portions 11K bent downward at the bases of the arms 11, the main pin 12 inserted through the main slit 14A and the main hole 11A provided in the distal end portion of the bent portion 11K, and a pair of the side pins 15 inserted for the respective arms 11 through the side slits 14B and the side holes 11B provided in the bases of the bent portions 11K.

However, the hanger 1 according to the embodiment of the prior example has a problem in that it is not easy to open and close the arms 11 with one hand and one touch.

First Embodiment

Figure 4:
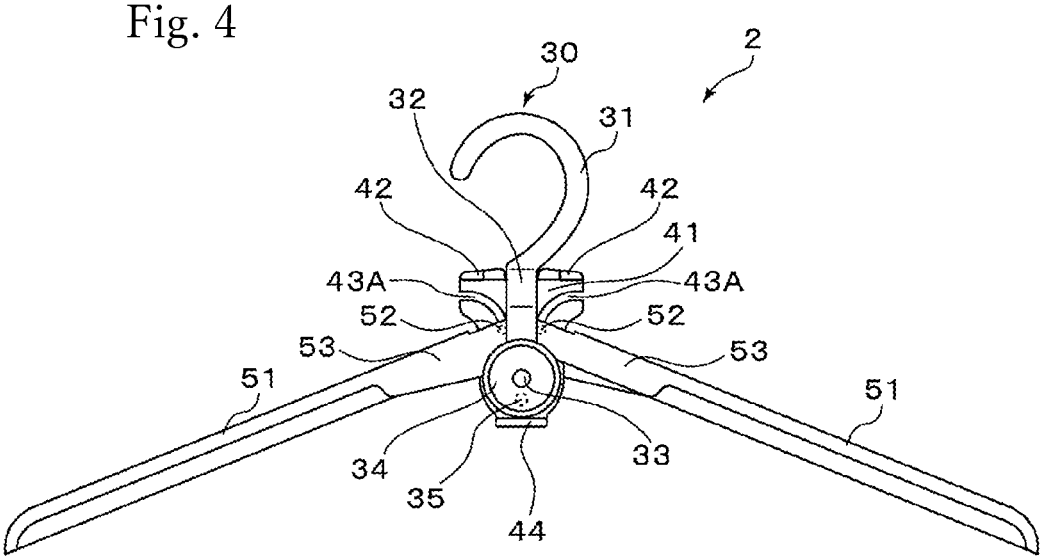
FIG. 4 is a front view illustrating a state where an arm of a hanger of a first embodiment is open.
Figure 5:
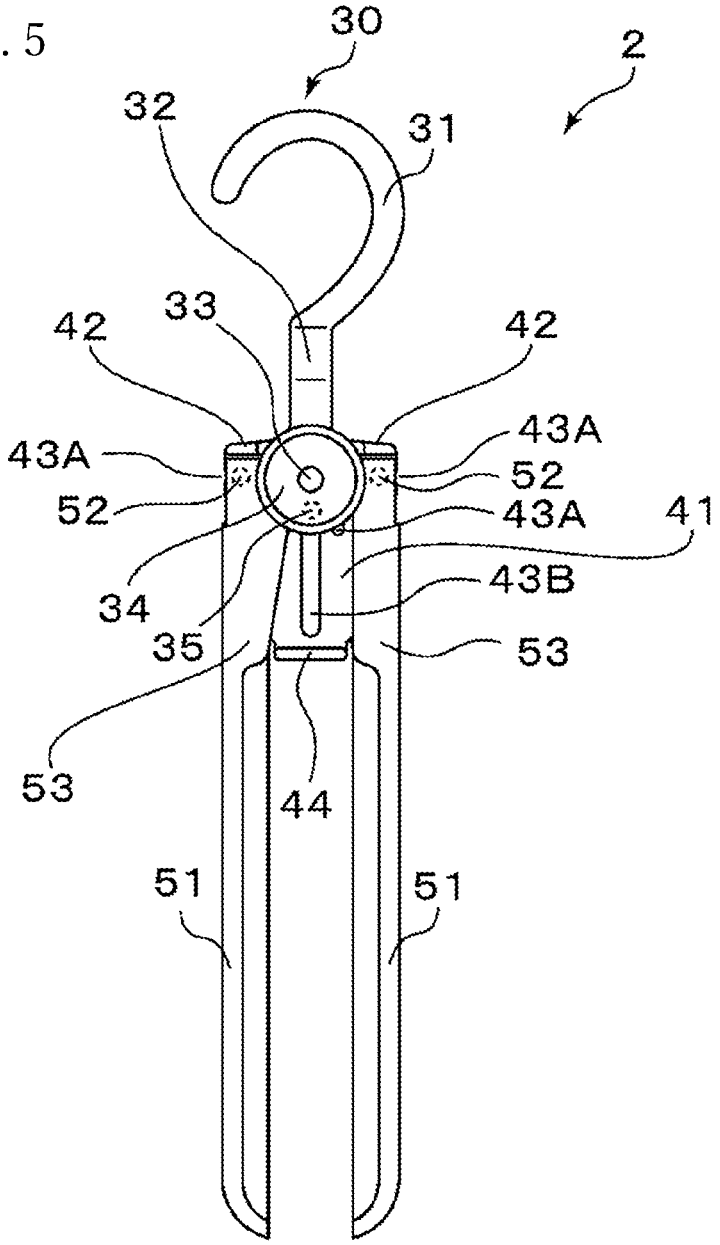
FIG. 5 is a front view illustrating a state where the arm of the hanger of the first embodiment is closed.
Figure 6:
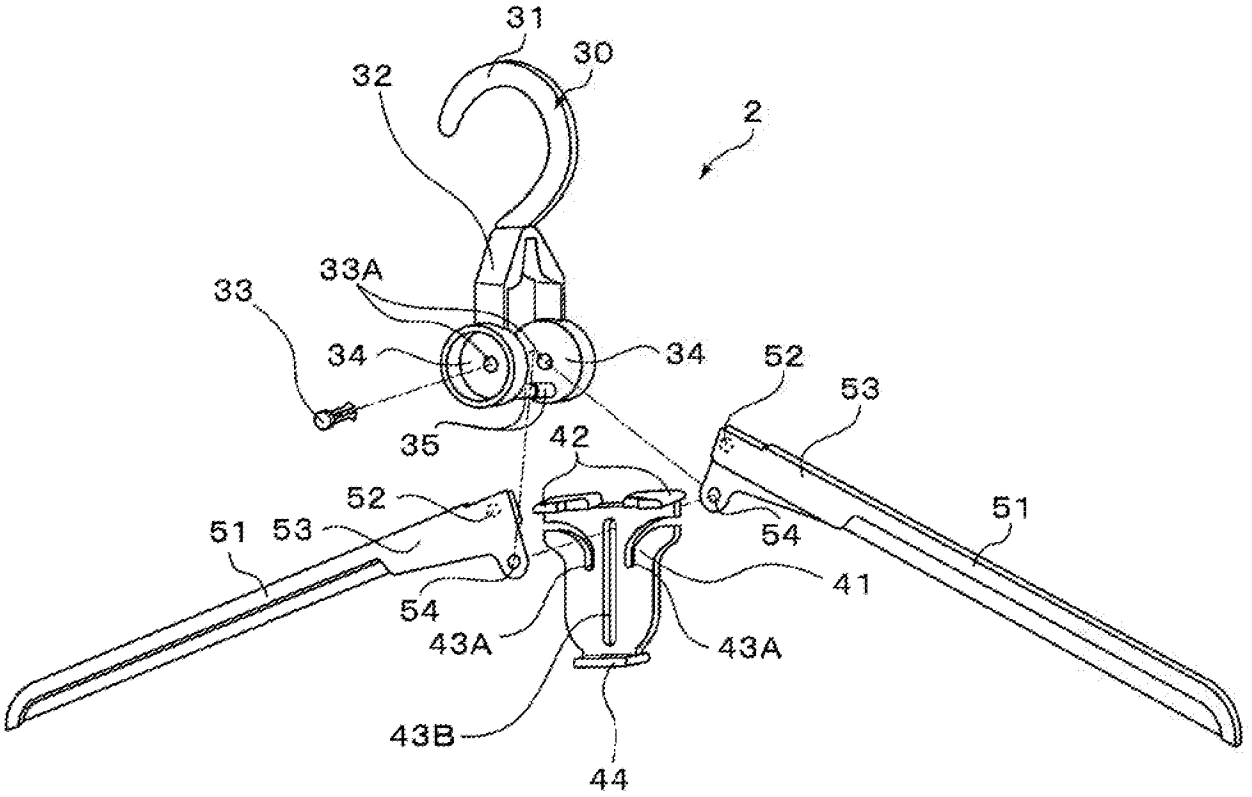
FIG. 6 is an exploded perspective view of the hanger of the first embodiment.
Figure 7:
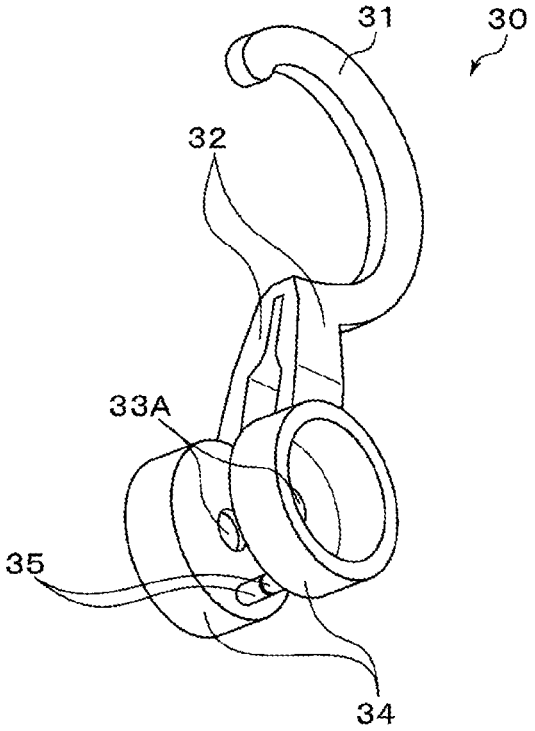
FIG. 7 is a perspective view of an operating portion of the first embodiment.
Figure 8:
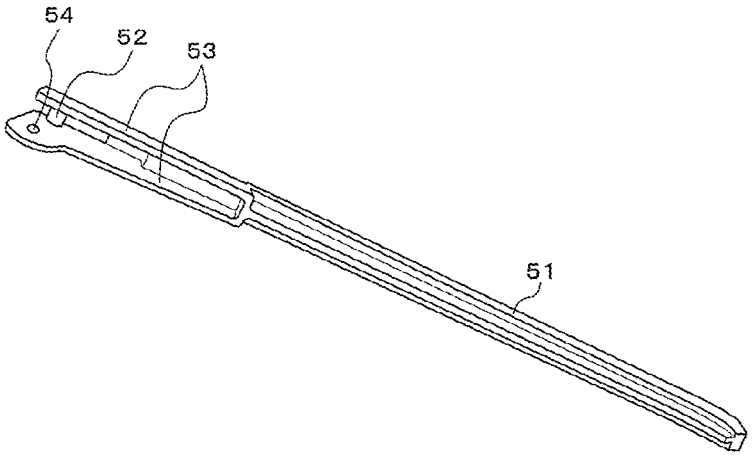
FIG. 8 is a perspective view of the arm of the first embodiment.
Figure 9:
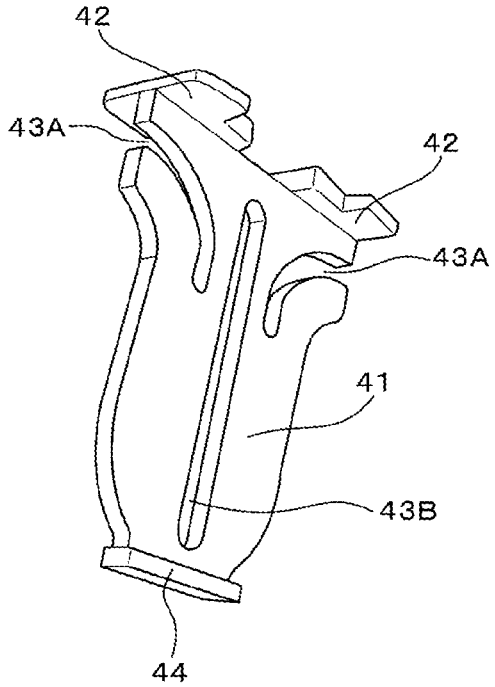
FIG. 9 is a perspective view of a main body portion of the first embodiment.

FIG. 4 is a front view illustrating a state where an arm 51 of a hanger 2 of the present embodiment is open, FIG. 5 is a front view illustrating a state where the arm 51 of the hanger 2 of the present embodiment is closed, FIG. 6 is an exploded perspective view of the hanger 2 of the present embodiment, FIG. 7 is a perspective view of an operating portion 30, FIG. 8 is a perspective view of the arm 51, and FIG. 9 is a perspective view of a main body portion 41.

As illustrated in FIGS. 4 to 9, the hanger 2 of the present embodiment is provided with the operating portion 30, the main body portion 41, a pair of the arms 51, and a pin 33.

The operating portion 30 is provided with a hook 31, a branching portion 32 which is disposed at a base of the hook 31 and which is divided into a fork to the front side and the rear side in FIG. 1, knobs 34 each having an insertion hole 33A in a central part thereof and disposed at lower ends of the branching portion 32, and a pair of projecting portions 35 provided on opposing surfaces of the knobs 34.

The branching portion 32, which has an elastic force, can be expanded in such a way as to separate the knobs 34 from each other by, for example, the thickness of the main body portion 41.

The main body portion 41 has a main slit 43B which extends in the vertical direction, a pair of side slits 43A which are provided on both sides of the main slit 43B at positions corresponding to the upper end portion of the main slit 43B, change to a downward orientation while curving toward the main slit 43B from both end portions of the main body portion 41, and then extend along the main slit 43B, a first handle 42 disposed in the upper end portion of the main body portion 41, and a second handle 44 disposed in the lower end portion of the main body portion 41. The upper end portions of the side slits 43A may or may not be respectively open to the edges on both sides of the main body portion 41.

The part of the side slit 43A that extends along the main slit 43B from the lower end of the curving part extends downward in parallel with the main slit 43B. The part of the side slit 43A that extends along the main slit 43B may not be parallel with the main slit 43B and may extend downward and outward or downward and inward insofar as the part deviates from the circumference of a circle having the curving part of the side slit 43A as an arc.

The operating portion 30 is connected to the main body portion 41 in such a way as to be displaceable. In other words, the operating portion 30 and the main body portion 41 are separately formed and displaceably interconnected in the present embodiment whereas the hook 13 and the main body portion are interconnected by being integrally formed in the embodiment of the prior example described above.

The main slit 43B and the two side slits 43A are provided in such a way that the upper end portion of the main slit 43B and the upper end portions of the two side slits 43A substantially line up in the lateral direction. Each of the side slits 43A may be formed in a circular arc shape or may include a straight line part in an end portion thereof. The side slit 43A extends halfway in the direction in which the main slit 43B extends.

Each arm 51 is provided with a base portion 53 having a cutout in a base, cut out to an end portion in a direction extending toward the base of the arm 51, and having a pin hole 54 in the vicinity of a distal end thereof, and a movement pin 52 which is provided in the base portion 53 in such a way as to cross the cutout.

It should be noted that the movement pin 52 may be formed integrally with the arm 51 or a pin formed separately from the arm 51 may be inserted through a hole with the hole provided in the base portion 53.

Next, a method for assembling the hanger 2 will be described.

The movement pin 52 of the arm 51 is fitted into the side slit 43A of the main body portion 41 from the open end.

The knob 34 of the operating portion 30 is opened and the projecting portion 35 is fitted into the main slit 43B.

The pin 33 is inserted through the insertion hole 33A and the pin hole 54 of each arm 51.

Next, the operation of the hanger 2 will be described.

The distance between the pin 33 and the lowermost bottom of the main slit 43B is reduced for the state of the arm 51 to be changed from the closed state to the open state. In other words, for the state of the arm 51 to be changed from the closed state to the open state, the knob 34 and the second handle 44 are pinched with fingers and the knob 34 is displaced in the direction of the second handle, that is, downward.

In a state where the arm 51 is closed, the pin 33 and the two movement pins 52 substantially line up in the lateral direction. When a downward force is applied to the pin 33 by the knob 34 being displaced downward in this state, the lateral component of the force becomes large enough to open the arm 51.

In other words, the movement pin 52 becomes a force point, the center-corresponding position in a case where the side slit 43A is a circumference becomes a fulcrum (virtual fulcrum), and the distal end of the arm 51 becomes a point of action. In this case, the distance between the fulcrum and the force point is sufficiently longer than the distance between the fulcrum and the point of action. Accordingly, the arm 11 can be opened even with a relatively small one-hand force.

Accordingly, the arm 51 can be opened with one hand and one touch.

When the arm 51 is completely open, the force in the direction to close the arm 51 becomes a force causing the movement pins 52 to head for each other, and thus the arm 51 is not closed even when clothing is hung on the arm 51.

The distance between the pin 33 and the lowermost bottom of the main slit 43B is increased for the state of the arm 51 to be changed from the open state to the closed state. In other words, for the state of the arm 51 to be changed from the open state to the closed state, the knob 34 and the first handle 42 are pinched with fingers and the knob 34 is displaced in the direction of the first handle.

The hanger 2 has an effect that the arm 11 can be closed with one touch, that is, it is possible to close the arm 11 simply by hanging the hook 31 onto a clothesline or the like and displacing the first handle 42 downward with a finger.

The movement pin 52 is displaced upward along the side slit 43A and the arm 51 is closed by the weight of the arm 51.

Accordingly, the arm 51 can be closed with one hand and one touch.

Figure 10:
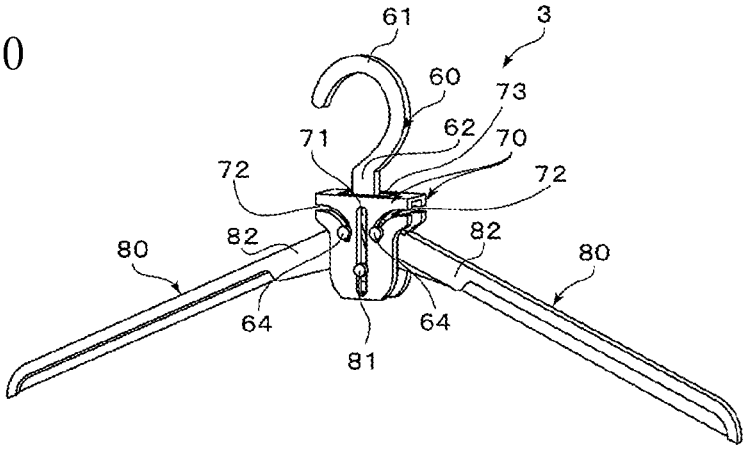
FIG. 10 is a perspective view of a hanger according to a modification example of the first embodiment.
Figure 11:
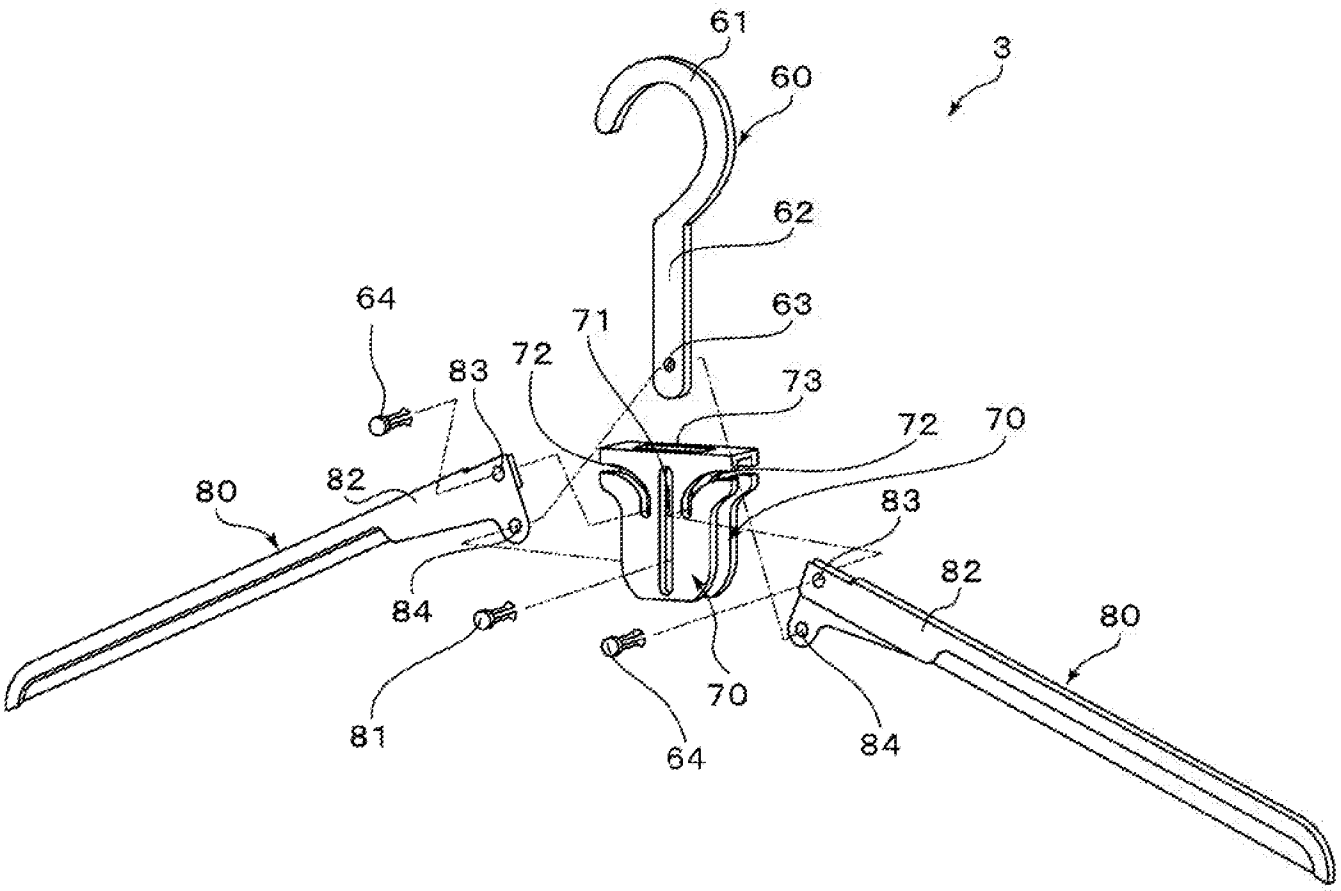
FIG. 11 is an exploded perspective view of the hanger according to the modification example of the first embodiment.

It should be noted that FIG. 10 is a perspective view of a hanger 3 according to a modification example of the hanger 2 of the present embodiment and FIG. 11 is an exploded perspective view of the hanger 3 of the present modification example. As illustrated in FIGS. 10 and 11, an operating portion 62 is not divided into a fork and a main body portion 70 is shaped in such a way as to be divided into a fork in the hanger 3 of the present modification example whereas the operating portion 30 is shaped in such a way as to be divided into a fork and the plate-shaped main body portion 41 is not divided into a fork in the hanger 2. It should be noted that neither the operating portion 30 nor the main body portion 41 may be divided into a fork in another modification example.

As illustrated in FIGS. 10 and 11, the hanger 3 is provided with a hook portion 60, a pair of the main body portions 70 interconnected at the upper ends thereof, and a pair of arms 80.

The hook portion 60 is provided with a hook 61 and the operating portion 62, which is disposed at the lower end of the hook 61 and has an insertion hole 63 in the lower end portion thereof.

The main body portion 70 has a main slit 71 which extends in the vertical direction and a pair of side slits 72 which are provided on both sides of the main slit 71, extend toward the main slit 71 from both sides, change to a downward orientation while curving ahead of the main slit 71, and then extend along the main slit 71. In addition, the main body portion 70 has an insertion hole 73 at the part of the connection. The operating portion 62 of the hook 61 is inserted into the insertion hole 73 in such a way as to be vertically displaceable.

The arm 80 is provided with a base portion 82, which has a side pin hole 83 disposed in the base of the arm 80 and provided on the extension direction of the arm 80 and a main pin hole 84 disposed below the side pin hole 83 in the front view in FIG. 11.

One main pin 81 is inserted through the main slit 71, the main pin hole 84 of each arm 80, and the insertion hole 63. In a state where the main pin 81 is fitted in the main pin hole 84, one end portion or both end portions of the main pin 81 protrude in the axial direction from the surface of the main body portion 70 to the extent that a finger can be put thereon. In addition, side pins 64 are respectively inserted through the side pin holes 83 and the inserted side pins 64 are fitted into the side slits 72.

It should be noted that the side pin 64 can be formed integrally with the arm 80 at the position of the side pin hole 83. In this case, the side pin hole 83 may not be provided. In addition, the upper end of the side slit 72 may not be open in a case where the side pin 64 is provided separately from the arm 80.

With the hanger 3 of the present modification example, it is possible to open the arm 80 by a single operation and with a small force, even with the hook hung on a clothesline, simply by pushing down the main body portion 70 with a finger. In addition, with the hanger 3 of the present modification example, it is possible to close the arm 80 by a single operation, that is, simply by displacing the main pin 81 upward with a finger.

As described above, the hanger 2 of the present embodiment is provided with the hook 31, the main body portion connected to the hook 31 and having the main slit 43B which extends in the vertical direction and into which the projecting portions 35 fit and the pair of side slits 43A which are provided on both sides of the main slit 43B, extend in the lateral direction from end portions on both sides toward the main slit 43B, change to the downward orientation while curving ahead of the main slit 43B, and then extend along the main slit 43B, the pair of arms 51 each provided with the base portion 53 having the pin hole 54 in the vicinity of the distal end thereof, and the movement pin 52 which is provided in the base portion 53 and which is inserted through the side slit 43A, and the pin 33 displaceably locking the arm 51 to the main body portion 41.

Specifically, the hanger 2 of the present embodiment is provided with: the operating portion 30 provided with the hook 31, the branching portion 32 which is disposed at the base of the hook 31 and which is divided into a fork to the front side and the rear side in a front view, the knobs 34 each having the insertion hole 33A in the central part thereof and disposed at the lower ends of the branching portion 32, and the pair of projecting portions 35 provided on the opposing surfaces of the knobs 34; the main body portion 41 including the main slit 43B which extends in the vertical direction and into which the projecting portions 35 fit, the pair of side slits 43A which are provided on both sides of the main slit 43B, extend in the lateral direction from the end portions on both sides toward the main slit 43B, change to the downward orientation while curving ahead of the main slit 43B, and then extend along the main slit 43B, the first handle 42 disposed above the main slit 43B, and the second handle 44 disposed below the main slit 43B; the pair of arms 51 each provided with the base portion 53 having the cutout in the base, cut out to the end portion in the direction extending toward the base, and having the pin hole 54 in the vicinity of the distal end thereof, and the movement pin 52 which is provided in the base portion 53 in such a way as to cross the cutout, and which is inserted through the corresponding side slit 43A; and the pin 33 inserted through the insertion holes 33A and the pin holes 54.

Furthermore, the hanger 3 of the present embodiment can be configured to be provided with the hook 61, the operating portion 62 extending downward from the base of the hook 61 and provided with the insertion hole 63 in the lower end portion thereof, the pair of main body portions 70 interconnected in the upper end portions thereof and having the vertically extending main slit 71 and the pair of side slits 72 which are provided on both sides of the main slit 71, extend toward the main slit 71 from both sides, change to the downward orientation while curving ahead of the main slit 71, and then extend along the main slit 71, the pair of arms 80 provided with the base portions 82 having the side pin holes 83 in the vicinity of the distal ends of the bases and the main pin holes 84 disposed below the side pin holes 83 in a front view and the pair of side pins 64 inserted through the side pin holes 83 and the side slits 72, and the main pin 81 inserted through the insertion hole 63, the main slit 71, and the main pin hole 84.

Achieved as a result is an effect that it is possible to provide a hanger which can be manufactured inexpensively, which allows the arm 51 to be opened and closed with one hand and one touch, and which can be quickly fitted to clothing.

In addition, the hanger 2 of the present embodiment has an effect that the arm 11 can be closed with one touch, that is, it is possible to close the arm 11 simply by hanging the hook 31 onto a clothesline or the like and displacing the first handle 42 downward with a finger.

Second Embodiment

Figure 12:
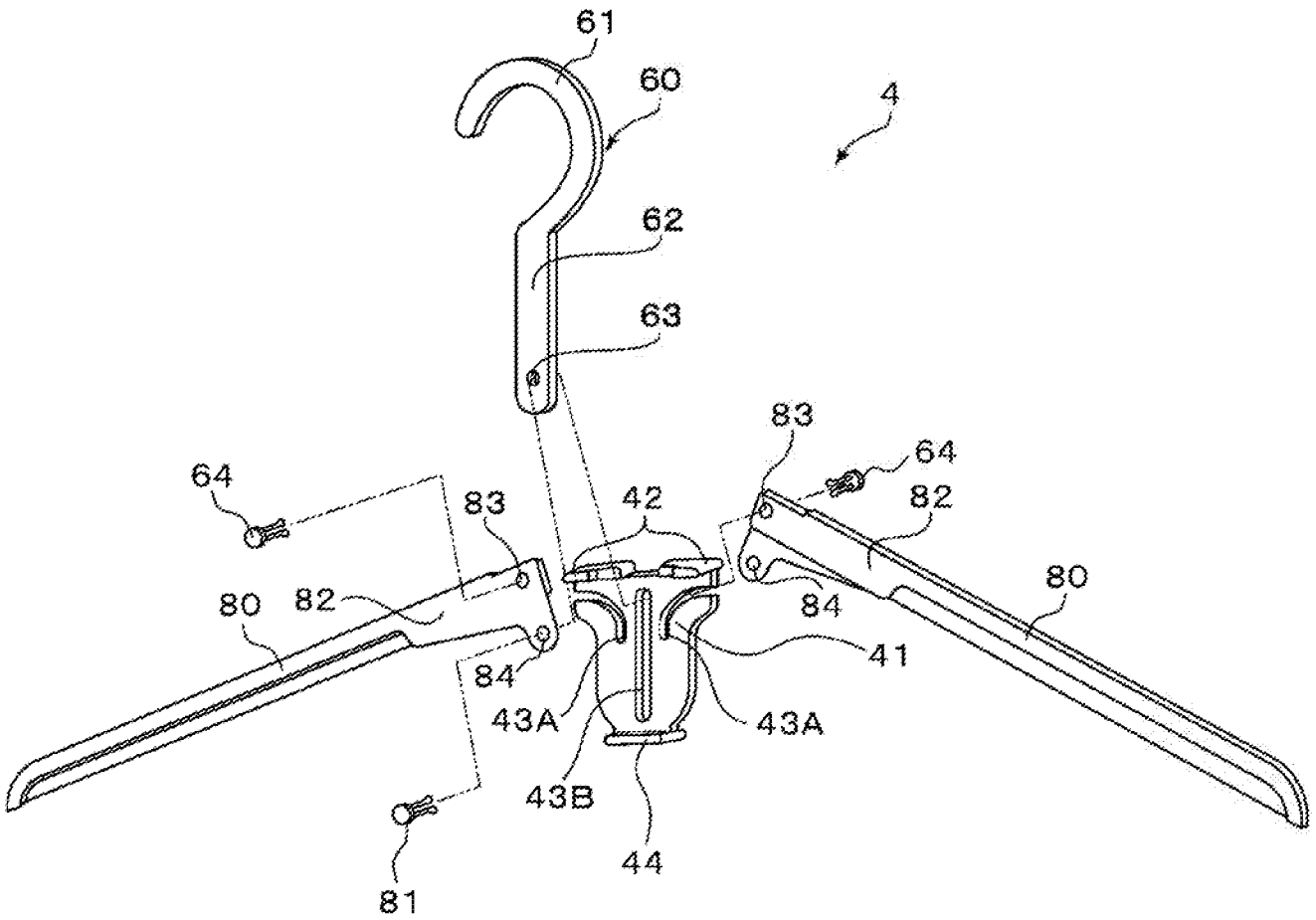
FIG. 12 is an exploded perspective view of a hanger of a second embodiment.
Figure 13:
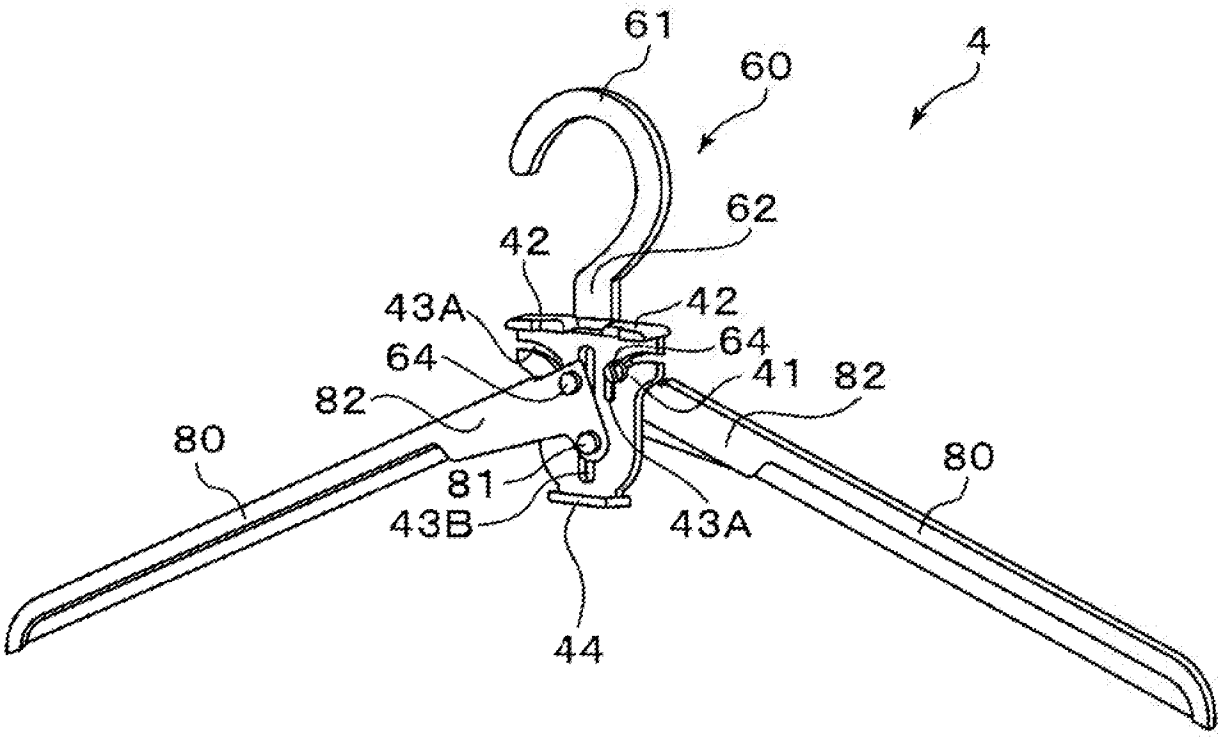
FIG. 13 is a front view illustrating a state where an arm of the hanger of the second embodiment is open.

FIG. 12 is a front view illustrating a state where the arm 80 of a hanger 4 of the present embodiment is open and FIG. 13 is an exploded perspective view of the hanger 4.

As illustrated in FIGS. 12 and 13, the hanger 4 of the present embodiment is provided with the hook portion 60, the main body portion 41, the pair of arms 80, and the main pin (the vertical, right-left, longitudinal, and lateral directions in the following description are based on the front view in FIG. 12).

The hook portion 60 is provided with the hook 61 and the operating portion 62, which is disposed at the base of the hook 61 and has the insertion hole 63 in the lower end portion thereof.

The main body portion 41 is provided separately from the hook portion 60 and in the shape of a single plate. The main body portion 41 has the main slit 43B which extends in the vertical direction, the pair of side slits 43A which are provided on both sides of the main slit 43B at the positions corresponding to the upper end portion of the main slit 43B, change to the downward orientation while curving toward the main slit 43B from both end portions of the main body portion 41, and then extend along the main slit 43B, the first handle 42 disposed in the upper end portion of the main body portion 41, and the second handle 44 disposed in the lower end portion of the main body portion 41. The upper end portions of the side slits 43A may or may not be respectively open to the edges on both sides of the main body portion 41.

The part of the side slit 43A that extends along the main slit 43B from the lower end of the curving part extends downward in parallel with the main slit 43B. The part of the side slit 43A that extends along the main slit 43B may not be parallel with the main slit 43B and may extend downward and outward or downward and inward insofar as the part deviates from the circumference of a circle having the curving part of the side slit 43A as an arc.

The main slit 43B and the two side slits 43A are provided in such a way that the upper end portion of the main slit 43B and the upper end portions of the two side slits 43A substantially line up in the lateral direction. Each of the side slits 43A may be formed in a circular arc shape or may include a straight line part in an end portion thereof. The side slit 43A extends halfway in the direction in which the main slit 43B extends.

The first handle 42 has a cutout at a position corresponding to the upper end portion of the main slit 43B and the cutout has a width allowing the operating portion 62 to fit.

Desirably, the pair of arms 80 are formed in the same shape for a decrease in the number of mold types. The arm 80 is provided with the side pin hole 83, which is a through hole, in the base portion 82 disposed in the distal end portion thereof and the main pin hole 84, which is a through hole disposed in the direction of approximately 120° downward with respect to the extension direction of the arm 80.

The specific shapes of the pair of arms 80 may be different from each other insofar as the pair of arms 80 have a common basic part such as the length of the arm 80 and the angle formed by the upper end portion when the arm 80 is open.

The main body portion 41 and the pair of arms 80 are pivotably locked by the main pin 81 being inserted through the main pin hole 84 and the main slit 43B and the side pin 64 being inserted through the side pin hole 83 and the side slit 43A.

One main pin 81 is inserted through the main slit 43B, the main pin hole 84 of each arm 80, and the insertion hole 63. In a state where the main pin 81 is fitted in the main pin hole 84, one end portion or both end portions of the main pin 81 protrude in the axial direction from the surface of the main body portion 41 to the extent that a finger can be put thereon. In addition, the side pins 64 are respectively inserted through the side pin holes 83 and the inserted side pins 64 are fitted into the side slits 43A.

The side slit 43A curves, and thus the side pin 64 moves smoothly. Accordingly, there is no need to operate the hanger 4 with both hands and an effect is achieved that the arm 80 can be opened and closed with one hand and one touch.

It should be noted that the side pin 64 can be formed integrally with the arm 80 at the position of the side pin hole 83. In this case, the side pin hole 83 may not be provided. In addition, the upper end of the side slit 43A may not be open in a case where the side pin 64 is provided separately from the arm 80.

The main pin 81 and the side pin 64 may be split pins having widened distal end portions or pins having two or more members such as bolts and nuts. It should be noted that the material of the hanger 4 is not particularly limited, the hanger 4 can be formed of one or more materials selected from, for example, resin, metal, wood, and paper, and the material is not limited thereto. As for the paper, cardboard, recycled paper, resin-coated paper, and the like can be used in addition to ordinary paper. In a case where the materials include paper, an effect is achieved that the paper part can be recycled.

Next, a method for assembling the hanger 4 will be described.

The side pin 64 is inserted through the side slit 43A of the main body portion 41 and the side pin hole 83 of the arm 80.

The main pin 81 is inserted through the main slit 43B of the main body portion 41, the main pin holes 84 of the pair of arms 80, and the insertion hole 63 of the operating portion 62.

Next, the operation of the hanger 4 will be described.

The distance between the main pin 81 and the lowermost bottom of the main slit 43B is reduced for the state of the arm 80 to be changed from the closed state to the open state. In other words, for the state of the arm 80 to be changed from the closed state to the open state, the main pin 81 and the second handle 44 are pinched with fingers and the main pin 81 is displaced in the direction of the second handle, that is, downward.

In a state where the arm 80 is closed, the main pin 81 and the two side pin holes 83 substantially line up in the lateral direction. When a downward force is applied to the main pin 81 by the main pin 81 being displaced downward in this state, the lateral component of the force becomes large enough to open the arm 80.

In other words, the side pin hole 83 becomes a force point, the center-corresponding position in a case where the side slit 43A is a circumference becomes a fulcrum (virtual fulcrum), and the distal end of the arm 80 becomes a point of action. In this case, the distance between the fulcrum and the force point is sufficiently longer than the distance between the fulcrum and the point of action. Accordingly, the arm 80 can be opened even with a relatively small one-hand force.

Accordingly, the arm 80 can be opened with one hand and one touch.

When the arm 80 is completely open, the force in the direction to close the arm 80 becomes a force causing the side pin holes 83 to head for each other, and thus the arm 80 is not closed even when clothing is hung on the arm 80.

The distance between the main pin 81 and the lowermost bottom of the main slit 43B is increased for the state of the arm 80 to be changed from the open state to the closed state. In other words, for the state of the arm 80 to be changed from the open state to the closed state, the main pin 81 and the first handle 42 are pinched with fingers and the main pin 81 is displaced in the direction of the first handle 42.

The hanger 4 has an effect that the arm 80 can be closed with one touch, that is, it is possible to close the arm 80 simply by hanging the hook 61 onto a clothesline or the like and displacing the first handle 42 downward with a finger.

The side pin hole 83 is displaced upward along the side slit 43A and the arm 80 is closed by the weight of the arm 80.

Accordingly, the arm 80 can be closed with one hand and one touch.

In addition, with the hanger 4, it is possible to close the arm 80 by a single operation and with a small force, even with the hook hung on a clothesline, simply by pushing down the main body portion 41 with a finger. In addition, with the hanger 4, it is possible to open the arm 80 by a single operation, that is, simply by displacing the main pin 81 upward with a finger.

As described above, the hanger 4 is provided with the hook 61, the operating portion 62 extending downward from the base of the hook 61 and provided with the insertion hole 63 in the lower end portion thereof, the main body portion 41 formed separately from the operating portion 62 and in the shape of a single plate and having the main slit 43B which extends in the vertical direction and the pair of side slits 43A which are provided on both sides of the main slit 43B, extend toward the main slit 43B, change to the downward orientation while curving ahead of the main slit 43B, and then extend along the main slit 43B, the pair of arms 80 provided with the base portions 82 having the main pin holes 84 in the vicinity of the distal ends of the bases and the pair of side pins 64 provided in the base portions 82 and inserted through the side slits 43A, and the main pin 81 inserted through the insertion hole 63, the main slit 43B, and the main pin hole 84.

Achieved as a result is an effect that it is possible to provide a hanger with which the arm 80 can be opened and closed with one hand and one touch and clothing can be easily attached and detached.

Third Embodiment

Figure 14:
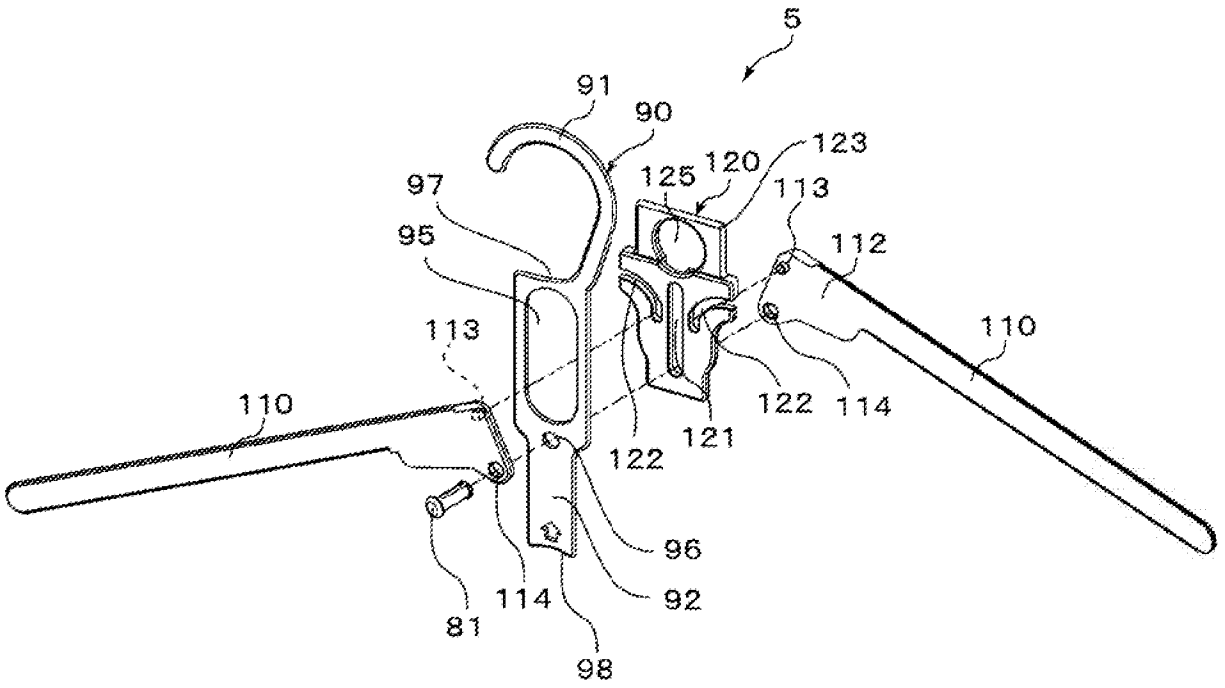
FIG. 14 is an exploded perspective view of a hanger of a third embodiment.
Figure 15:
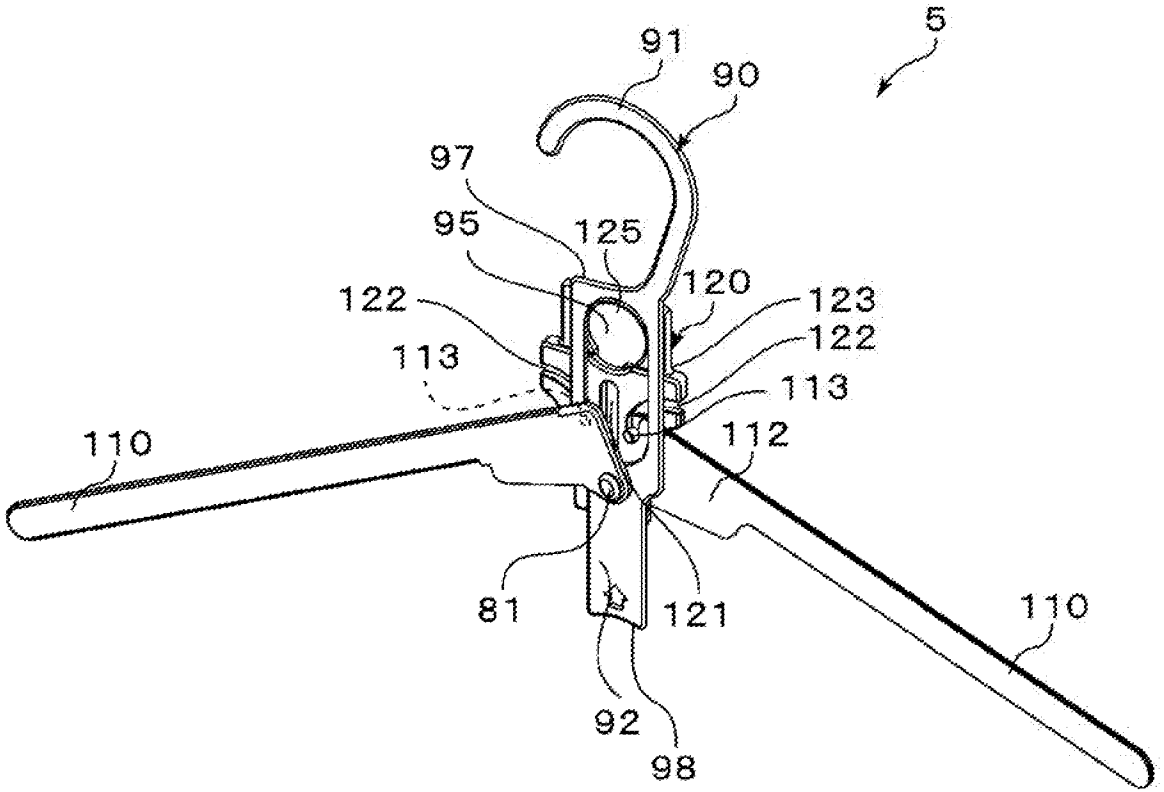
FIG. 15 is a perspective view illustrating a state where an arm of the hanger of the third embodiment is open.
Figure 16:
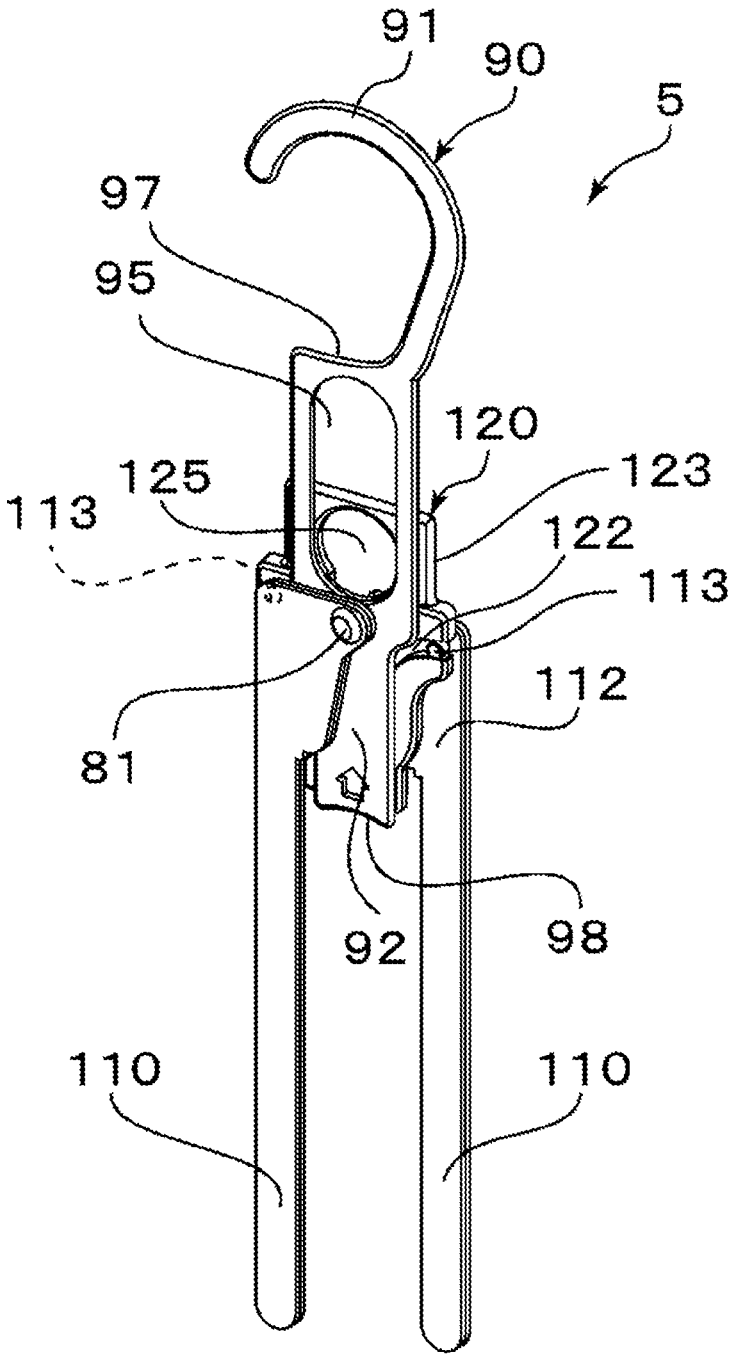
FIG. 16 is a perspective view illustrating a state where the arm of the hanger of the third embodiment is closed.

FIG. 14 is an exploded perspective view of a hanger 5 of the present embodiment, FIG. 15 is a perspective view illustrating a state where an arm 110 of the hanger 5 is open, and FIG. 16 is a perspective view illustrating a state where the arm 110 of the hanger 5 is closed (the vertical, right-left, longitudinal, and lateral directions in the following description are based on the front view in FIG. 3).

As illustrated in FIGS. 14 to 16, the hanger 5 of the present embodiment is provided with a hook portion 90, a main body portion 120, a pair of the arms 110, and the main pin 81.

The hook portion 90 is provided with a hook 91 and an operating portion 92, which is disposed at the base of the hook 91 and has a first finger hole 95 and an insertion hole 96 disposed below the first finger hole 95. The first finger hole 95 has a breadth enough for finger insertion and a longitudinal width equal to or longer than the vertical length of a main slit 121 (described later).

The main body portion 120 is provided separately from the hook portion 90 and in the shape of a single plate. The main body portion 120 has the main slit 121 which extends in the vertical direction, a pair of side slits 122 which are provided on both sides of the main slit 121 at positions corresponding to the upper end portion of the main slit 121, change to a downward orientation while curving toward the main slit 121 from both end portions of the main body portion 120, and then extend along the main slit 121, and a first handle 123 having a second finger hole 125 disposed in the upper end portion of the main body portion 120. The upper end portions of the side slits 122 may or may not be respectively open to the edges on both sides of the main body portion 120.

The part of the side slit 122 that extends along the main slit 121 from the lower end of the curving part extends downward in parallel with the main slit 121. The part of the side slit 122 that extends along the main slit 121 may not be parallel with the main slit 121 and may extend downward and outward or downward and inward insofar as the part deviates from the circumference of a circle having the curving part of the side slit 122 as an arc.

The main slit 121 and the two side slits 122 are provided in such a way that the upper end portion of the main slit 121 and the upper end portions of the two side slits 122 substantially line up in the lateral direction. Each of the side slits 122 may be formed in a circular arc shape or may include a straight line part in an end portion thereof. The side slit 122 extends halfway in the direction in which the main slit 121 extends.

Desirably, the pair of arms 110 are formed in the same shape for a decrease in the number of mold types. The arm 110 is provided with a side pin 113 molded integrally with the arm 110 protruding in the direction of the main body portion 120 in a base portion 112 disposed in the distal end portion thereof and a main pin hole 114, which is a through hole disposed in the direction of approximately 120° downward with respect to the extension direction of the arm 110.

The specific shapes of the pair of arms 110 may be different from each other insofar as the pair of arms 110 have a common basic part such as the length of the arm 110 and the angle formed by the upper end portion when the arm 110 is open.

The main body portion 120 and the pair of arms 110 are pivotably locked by the main pin 81 being inserted through the main pin hole 114 and the main slit 121 and the side pin 113 being inserted through the side slit 122.

One main pin 81 is inserted through the main slit 121, the main pin hole 114 of each arm 110, and the insertion hole 96. In addition, the side pin 113 is fitted into the side slit 122.

The side slit 122 curves, and thus the side pin 113 moves smoothly. Accordingly, there is no need to operate the hanger 5 with both hands and an effect is achieved that the arm 110 can be opened and closed with one hand and one touch.

It should be noted that the arm 80 and the side pin 64 illustrated in the first embodiment may be used in place of the arm 110. The insertion location of the side pin 64 in this case is the same as in the first embodiment.

The main pin 81 maybe a split pin having a widened distal end portion or a pin having two or more members such as a bolt and a nut. It should be noted that the material of the hanger 5 is not particularly limited, the hanger 5 can be formed of one or more materials selected from, for example, resin, metal, wood, and paper, and the material is not limited thereto. As for the paper, cardboard, recycled paper, resin-coated paper, and the like can be used in addition to ordinary paper. In a case where the materials include paper, an effect is achieved that the paper part can be recycled.

Next, a method for assembling the hanger 5 will be described.

The side pin 113 of the arm 110 is inserted through the side slit 122 of the main body portion 120.

The main pin 81 is inserted through the main slit 121 of the main body portion 120, the main pin holes 114 of the pair of arms 110, and the insertion hole 96 of the operating portion 92.

Next, the operation of the hanger 5 will be described.

The distance between the main pin 81 and the lowermost bottom of the main slit 121 is reduced for the state of the arm 110 to be changed from the closed state to the open state. In other words, for the state of the arm 110 to be changed from the closed state to the open state, a first finger hook portion 97 positioned above the first finger hole 95 and the upper end portion of the second finger hole 125 are pinched with fingers and the first finger hook portion 97 and the upper end portion of the second finger hole 125 are brought close to each other. As a result of this operation, the main pin 81 moves downward from above in the main slit 121 and the side pin 113 is displaced downward from above in the side slit 122. Accordingly, the state of the arm 110 is changed from the closed state to the open state.

In a state where the arm 110 is closed, the main pin 81 and the two side pins 113 substantially line up in the lateral direction. When the main pin 81 is displaced downward in this state, that is, when a downward force is applied to the main pin 81 in this state, the lateral component of the force becomes large enough to open the arm 110.

In other words, the side pin 113 becomes a force point, the center-corresponding position in a case where the side slit 122 is a circumference becomes a fulcrum (virtual fulcrum), and the distal end of the arm 110 becomes a point of action. In this case, the distance between the fulcrum and the force point is sufficiently longer than the distance between the fulcrum and the point of action. Accordingly, the arm 110 can be opened even with a relatively small one-hand force.

Accordingly, the arm 110 can be opened with one hand and one touch.

When the arm 110 is completely open, the force in the direction to close the arm 110 becomes a force causing the side pins 113 to head for each other, and thus the arm 110 is not closed even when clothing is hung on the arm 110.

The distance between the main pin 81 and the lowermost bottom of the main slit 121 is increased for the state of the arm 110 to be changed from the open state to the closed state. In other words, for the state of the arm 110 to be changed from the open state to the closed state, a second finger hook portion 98 corresponding to the lower end portion of the operating portion 92 and the lower end portion of the second finger hole 125 of the main body portion 120 are pinched with fingers and the second finger hook portion 98 and the lower end portion of the second finger hole 125 are brought close to each other. As a result of this operation, the main pin 81 moves upward from below in the main slit 121 and the side pin 113 is displaced upward from below in the side slit 122. Accordingly, the state of the arm 110 is changed from the open state to the closed state.

The hanger 5 has the first finger hole 95 and the second finger hole 125, and thus the main pin 81 inserted through the insertion hole 96 of the operating portion 92 can be displaced with one hand and one touch with respect to the main body portion 120. Accordingly, an effect is achieved that the arm 110 can be opened and closed with one hand and one touch.

In addition, with the hanger 5, it is possible to close the arm 110 by a single operation and with a small force, even with the hook hung on a clothesline, simply by pushing down the main body portion 120 with a finger. In addition, with the hanger 5, it is possible to open the arm 110 by a single operation, that is, simply by displacing the main pin 81 upward with a finger.

As described above, the hanger 5 is provided with the hook 91, the operating portion 92 extending downward from the base of the hook 91 and provided with the insertion hole 96 in the lower end portion thereof, the main body portion 120 formed separately from the operating portion 92 and in the shape of a single plate and having the main slit 121 which extends in the vertical direction and the pair of side slits 122 which are provided on both sides of the main slit 121, extend toward the main slit 121, change to the downward orientation while curving ahead of the main slit 121, and then extend along the main slit 121, the pair of arms 110 provided with the base portions 112 having the main pin holes 114 in the vicinity of the distal ends of the bases and the pair of side pins 113 provided in the base portions 112 and inserted through the side slits 122, and the main pin 81 inserted through the insertion hole 96, the main slit 121, and the main pin hole 114.

And, in the hanger 5, the operating portion 92 further includes the first finger hole 95 provided above the insertion hole 96 and having a breadth enough for finger insertion and a longitudinal width equal to or longer than the vertical length of the main slit 121 and the main body portion 120 further includes the second finger hole 125 provided above the main slit 121 and having a size enough for finger insertion.

Achieved as a result is an effect that it is possible to provide a hanger with which the arm 80 can be more easily opened and closed with one hand and one touch and clothing can be easily attached and detached.

Fourth Embodiment

Figure 17:
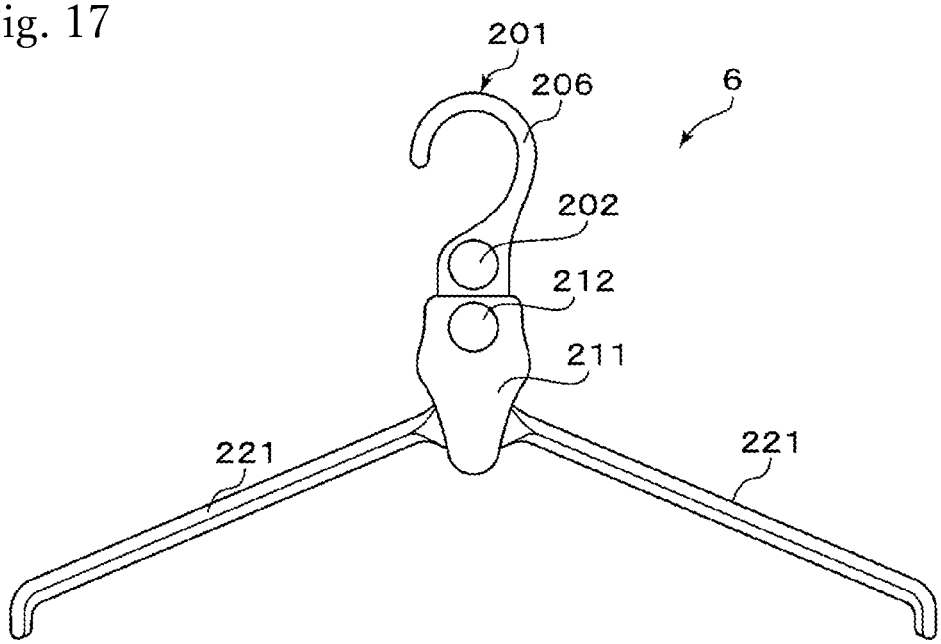
FIG. 17 is a front view illustrating a state where an arm of a hanger of a fourth embodiment is open.
Figure 18:
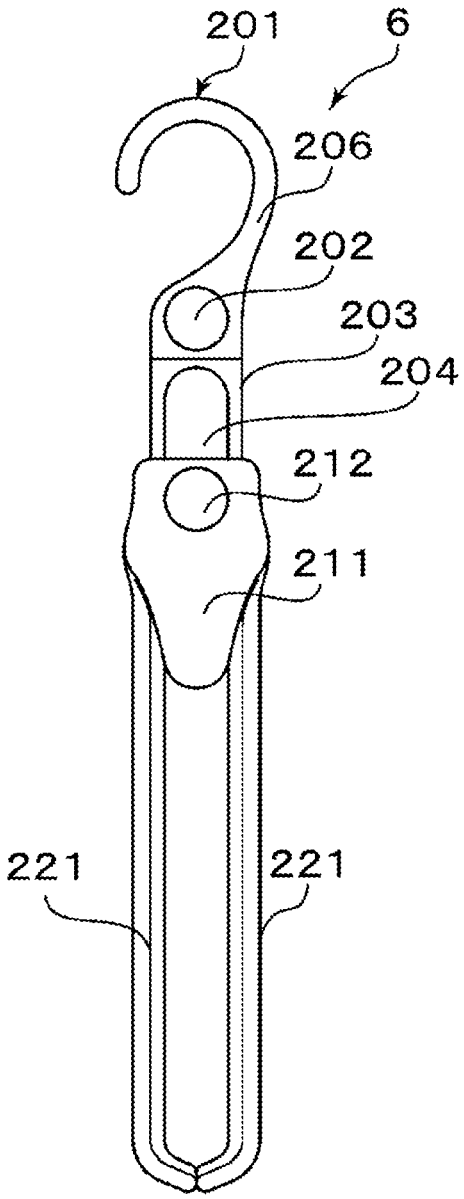
FIG. 18 is a front view illustrating a state where the arm of the hanger of the fourth embodiment is closed.
Figure 19:
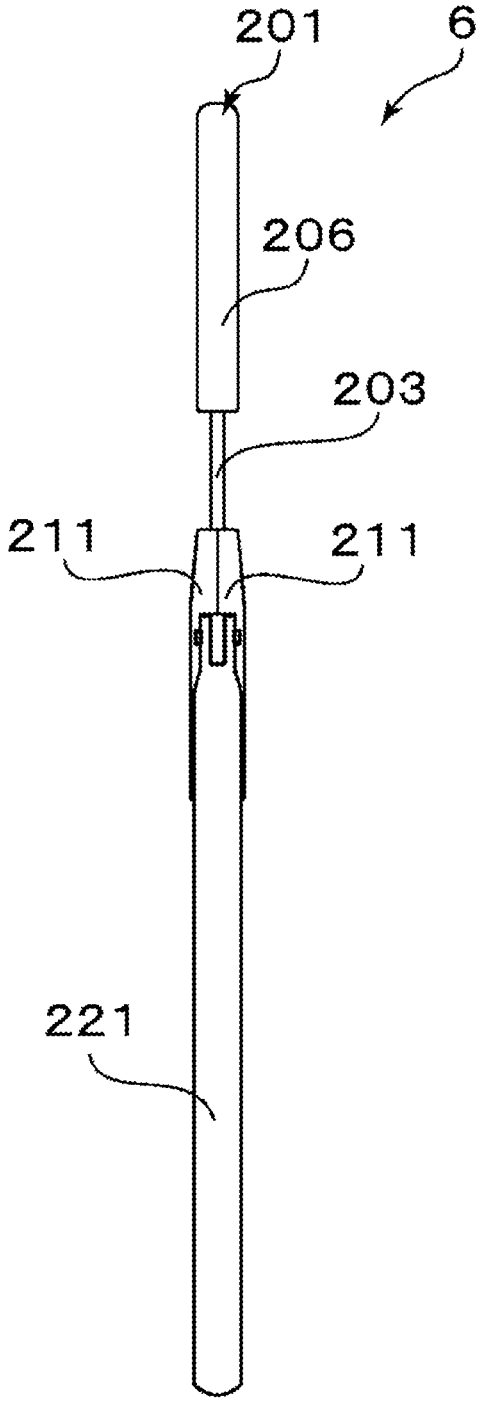
FIG. 19 is a right side view illustrating a state where the arm of the hanger of the fourth embodiment is closed.

FIG. 17 is a front view illustrating a state where an arm 221 of a hanger 6 of the present embodiment is open, FIG. 18 is a front view illustrating a state where the arm 221 of the hanger 6 is closed, and FIG. 19 is a right side view illustrating a state where the arm 221 of the hanger 6 is closed.

As illustrated in FIGS. 17 to 19, the hanger 6 of the present embodiment is provided with a hook portion 201, a pair of main body portions 211, and a pair of the arms 221 (the vertical, right-left, longitudinal, and lateral directions in the following description are based on the front view in FIG. 12).

Figure 20:
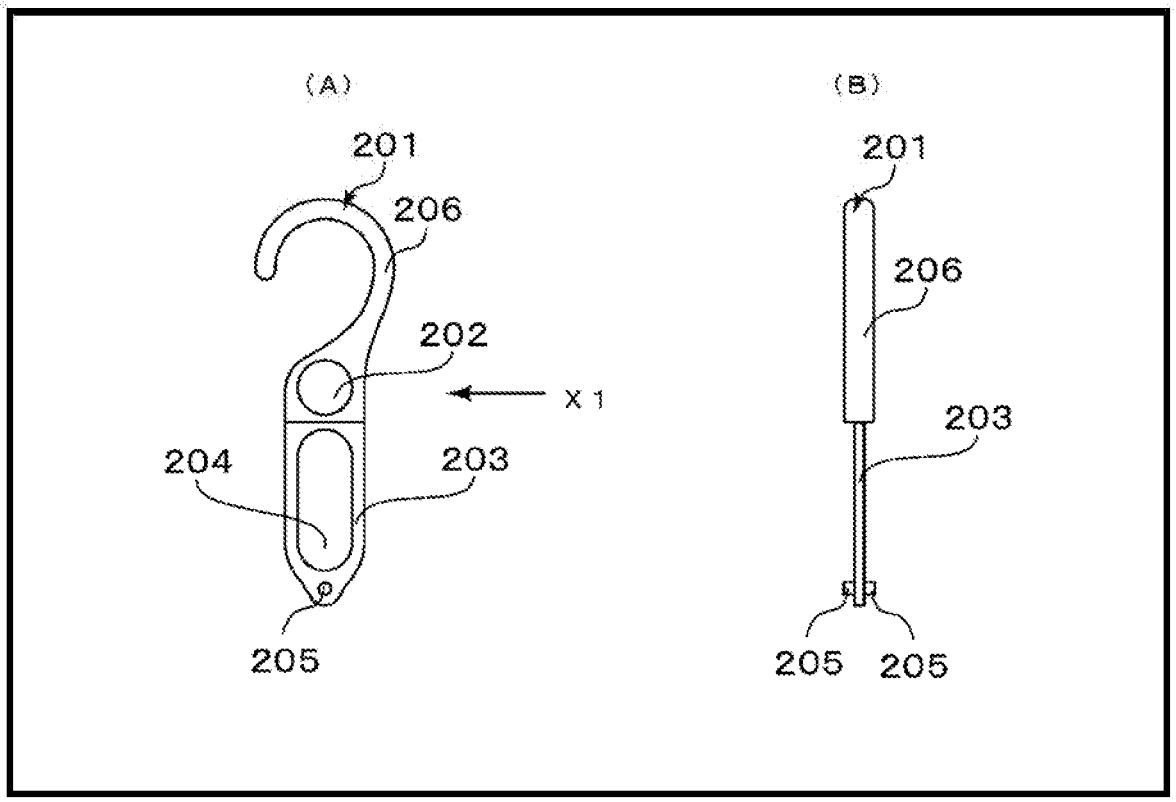
FIG. 20 is a diagram illustrating a hook portion of the hanger of the fourth embodiment.

FIG. 20 is a diagram illustrating the hook portion 201. FIG. 20(A) is a front view of the hook portion 201 and FIG. 20(B) is an X1 arrow view of the hook portion 201.

As illustrated in FIG. 20, the hook portion 201 is provided with a hook 206 and an operating portion 203. A first finger hole 202 is large enough to pass a finger and disposed in the lower portion of the hook 206. The operating portion 203 has a long hole 204 and main pins 205. The long hole 204 is disposed below the first finger hole 202 and large enough to pass a finger. The protruding main pins 205, which are disposed below the long hole 204, are respectively provided on the front and back of the operating portion 203.

The length of the lateral diameter of the first finger hole 202 is substantially equal to the length of the breadth of the long hole 204. The depth-direction thickness of the operating portion 203 is smaller than the depth-direction thickness of the hook 206.

Figure 21:
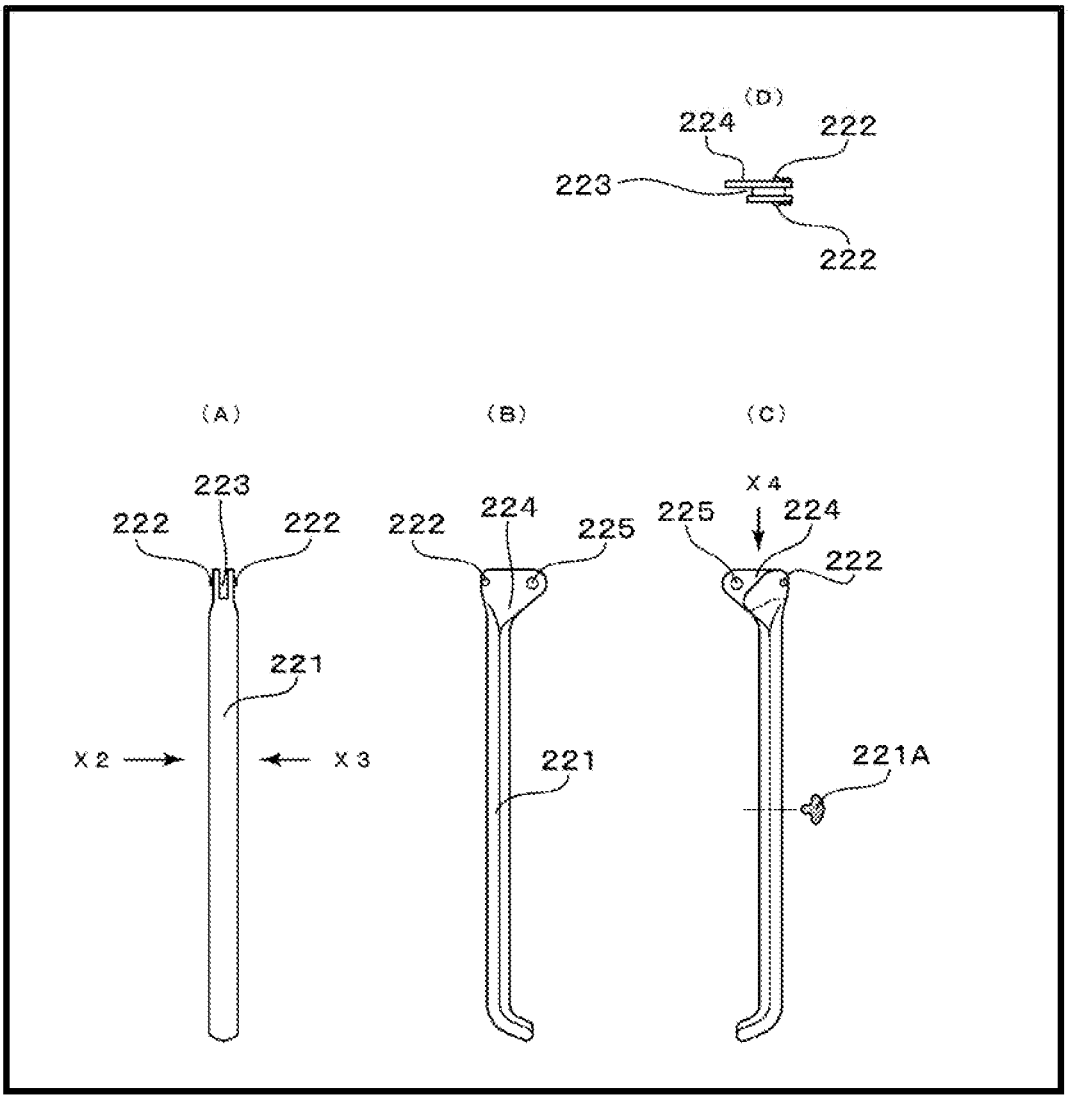
FIG. 21 is a diagram illustrating the arm of the hanger of the fourth embodiment.

FIG. 21 is a diagram illustrating the arm 221. FIG. 21(A) is a plan view of the arm 221, FIG. 21(B) is a front view of the arm 221 that is on the left side, FIG. 21(C) is a rear view of the arm 221 that is on the left side, and FIG. 21(D) is an X4 arrow view of the arm 221.

As illustrated in FIG. 21, the arm 221 has a length and a width suitable for hanging clothing and is provided with a base portion 224 at the base thereof. The base portion 224 has protruding side pins 222 respectively provided on the front and back of the base portion 224 and a main pin hole 225, which is a through hole disposed in such a way as to be below the side pin 222 in the open state.

The base portion 224 has a groove portion 223 in an end portion in the extension direction of the arm 221 and the base portion 224 that is on the rear side is cut out short by the base portion 224 on the front side in such a way that the main pin hole 225 is visible.

A cross section 221A of the arm 221 is formed in such a way that the width of the lower side is decreased in a state where the arm 221 is open.

The pair of arms 221 may be formed in the same shape or different shapes.

Figure 22:
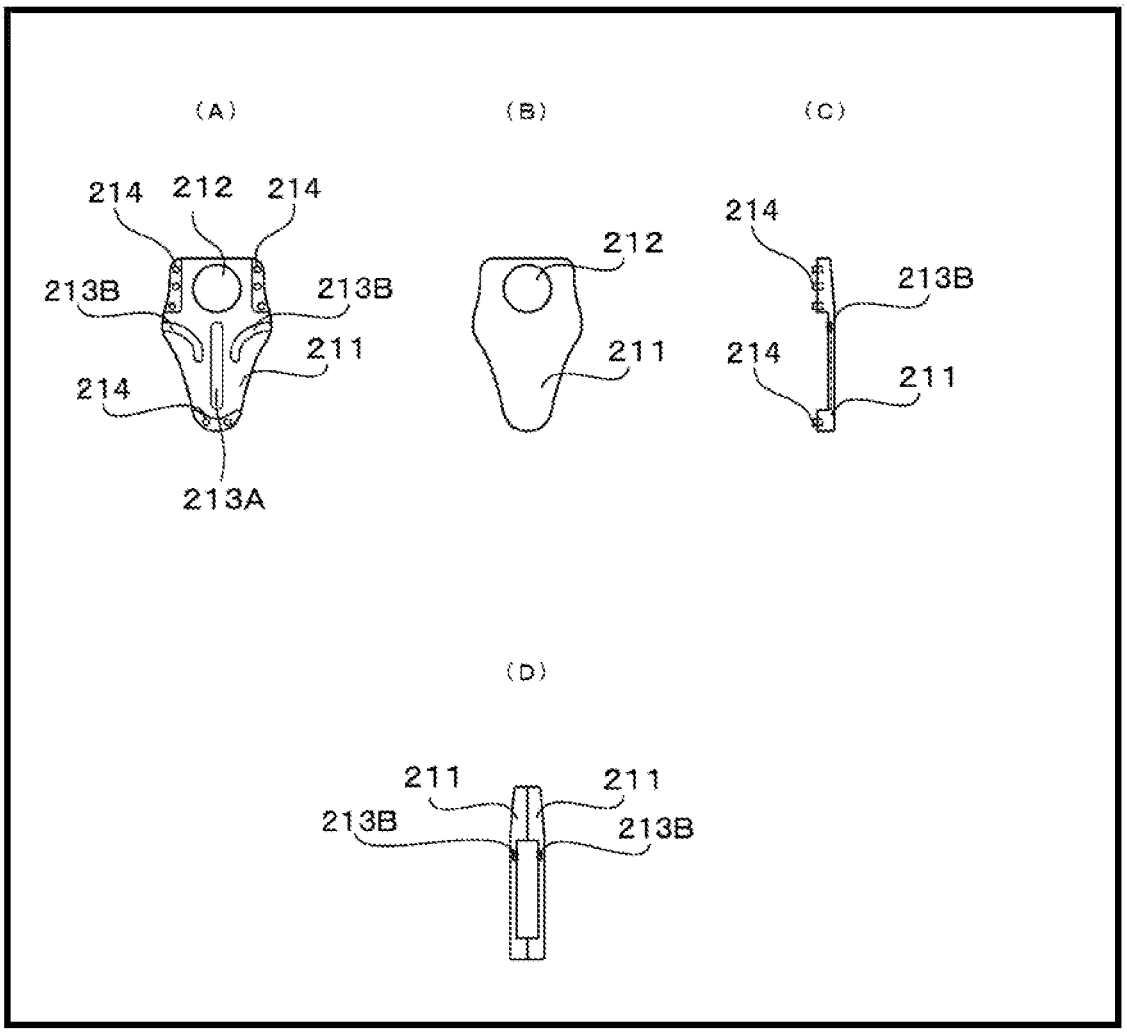
FIG. 22 is a diagram illustrating a main body portion of the hanger of the fourth embodiment.

FIG. 22 is a diagram illustrating the main body portion 211, FIG. 22(A) is a rear view of the main body portion 211, FIG. 22(B) is a front view of the main body portion 211, FIG. 22(C) is a left side view of the main body portion 211, and FIG. 22(D) is a diagram illustrating a state where the pair of main body portions 211 are combined with each other.

As illustrated in FIG. 22, the upper half of the main body portion 211 has a substantially rectangular shape and the lower half of the main body portion 211 has a substantially inverted triangle shape. The main body portion 211 is provided with a second finger hole 212 in the upper portion of the main body portion 211 and the second finger hole 212 is large enough to pass a finger.

The main body portion 211 is provided separately from the hook portion 201 and in the shape of a single plate. The main body portion 211 has a main groove portion 213A which is a groove extending in the vertical direction and a pair of side groove portions 213B as grooves which are provided on both sides of the main groove portion 213A at positions corresponding to the upper end portion of the main groove portion 213A, change to a downward orientation while curving toward the main groove portion 213A from both end portions of the main body portion 211, and then extend along the main groove portion 213A. The upper end portions of the side groove portions 213B may or may not be respectively open to the edges on both sides of the main body portion 211.

The part of the side groove portion 213B that extends along the main groove portion 213A from the lower end of the curving part extends downward in parallel with the main groove portion 213A. The part of the side groove portion 213B that extends along the main groove portion 213A may not be parallel with the main groove portion 213A and may extend downward and outward or downward and inward insofar as the part deviates from the circumference of a circle having the curving part of the side groove portion 213B as an arc.

The main groove portion 213A and the two side groove portions 213B are provided in such a way that the upper end portion of the main groove portion 213A and the upper end portions of the two side groove portions 213B substantially line up in the lateral direction. Each of the side groove portions 213B may be formed in a circular arc shape or may include a straight line part in an end portion thereof. The side groove portion 213B extends halfway in the direction in which the main groove portion 213A extends.

One of the pair of main body portions 211 is provided with a fitting portion 214 fitting with the other main body portion 211 except for the part where the hook portion 201 and the arm 221 are inserted through the edge of the main body portion 211. The fitting portion 214 is a recess in the other main body portion 211 whereas the fitting portion 214 has the form of a projection in FIG. 22.

The pair of main body portions 211 are formed in the same shape except for the fitting portions 214. The main body portions 211 may be decorated and the decorations of the two main body portions 211 may be different from each other.

Next, a method for assembling the hanger 6 will be described. First, one arm 221 is placed onto one main body portion 211 in such a way that the side pin 222 fits into the side groove portion 213B.

Next, the hook portion 201 is placed in such a way that the main pin 205 fits into the main pin hole 225 and the main groove portion 213A.

Next, the other arm 221 is placed in such a way that the side pin 222 fits into the other side groove portion 213B and the main pin 205 fits into the main pin hole 225.

Lastly, the other main body portion 211 is placed in such a way that the main pin 205 fits into the main groove portion 213A and the side pin 222 fits into the side groove portion 213B and the fitting portions 214 are fitted to each other.

Figure 23:
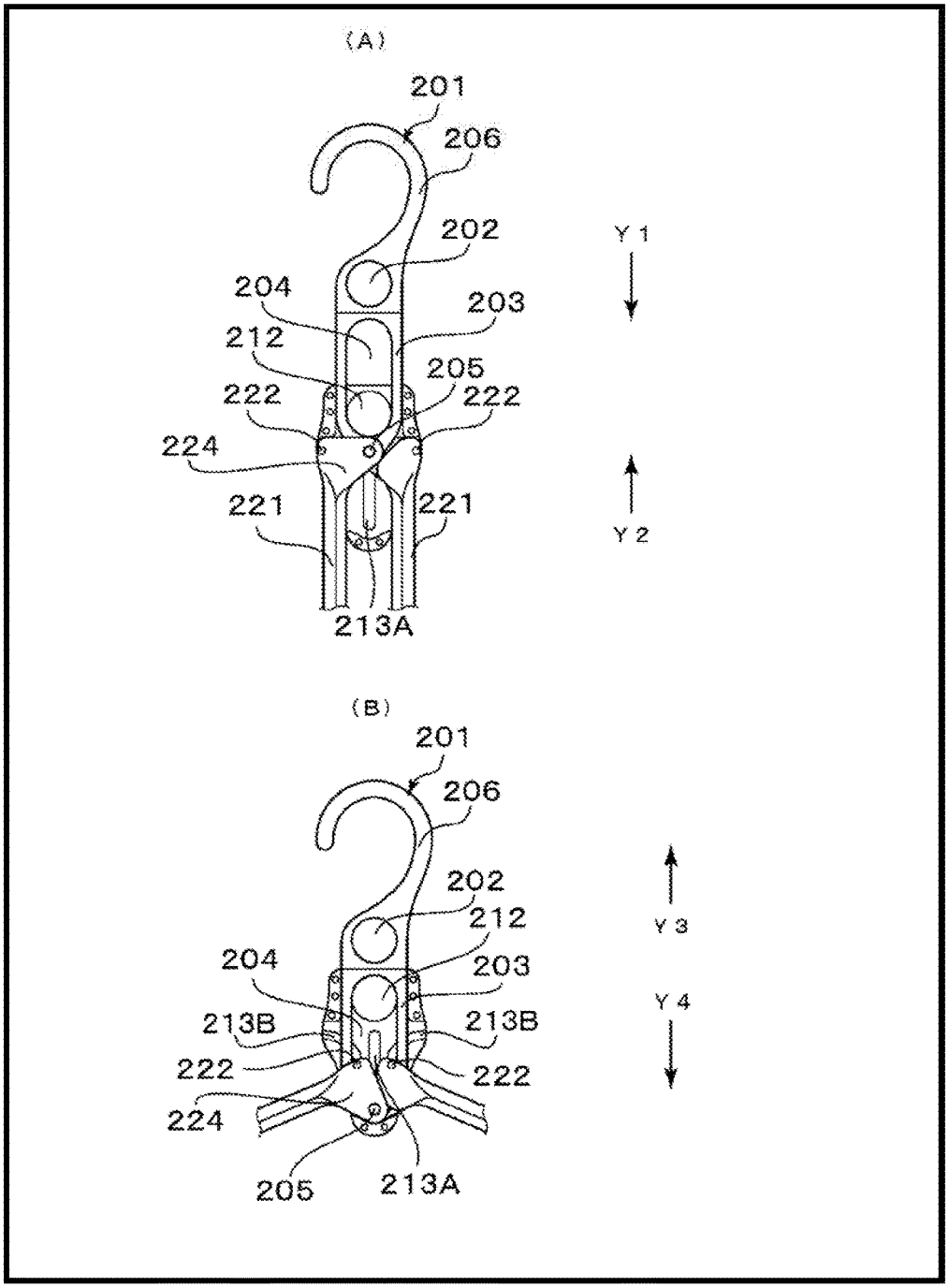
FIG. 23 is a diagram illustrating how the hanger of the fourth embodiment is opened and closed.

FIG. 23 is a diagram illustrating how the hanger 6 is opened and closed. Illustrated in FIG. 23 is a state where the main body portion 211 on the front side is removed. FIG. 23(A) illustrates a state where the arm 221 is closed and FIG. 23(B) illustrates a state where the arm 221 is open.

For the state of the arm 221 to be changed from the closed state to the open state, a finger is inserted into each of the first finger hole 202 and the second finger hole 212, the bottom portion of the first finger hole 202 is pressed in the direction of an arrow Y1, the upper portion of the second finger hole 212 is pressed in the direction of an arrow Y2, and then the bottom and upper portions are brought close to each other.

As a result of the pressing described above, the main pin 205 moves downward from above in the main groove portion 213A and the side pin 222 moves downward from above in the side groove portion 213B.

The distance between the side pins 222 decreases and the state of the pair of arms 221 is changed from the closed state to the open state. The side groove portion 213B curves, and thus it is possible to open the arm 221 smoothly, with one hand, and by a single operation (with one touch) at this time.

For the state of the arm 221 to be changed from the open state to the closed state, a finger is inserted into each of the first finger hole 202 and the second finger hole 212, the upper portion of the first finger hole 202 is pressed in the direction of an arrow Y3, the bottom portion of the second finger hole 212 is pressed in the direction of an arrow Y4, and then the bottom and upper portions are moved away from each other.

As a result of the pressing described above, the main pin 205 moves upward from below in the main groove portion 213A and the side pin 222 moves upward from below in the side groove portion 213B.

The distance between the side pins 222 increases and the state of the pair of arms 221 is changed from the open state to the closed state. The side groove portion 213B curves, and thus it is possible to close the arm 221 smoothly, with one hand, and by a single operation (with one touch) at this time.

Figure 24:
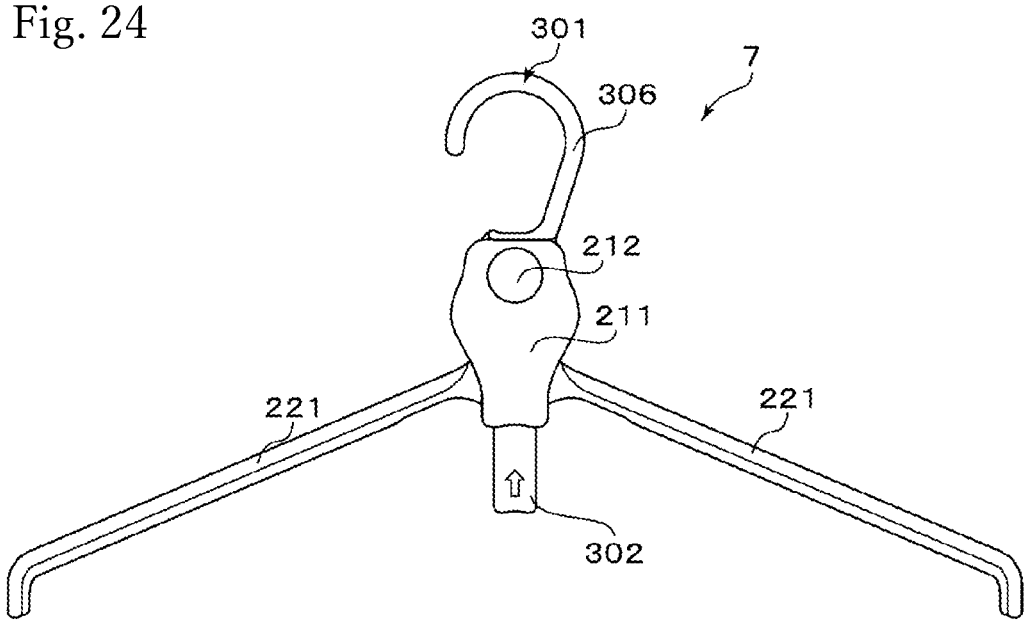
FIG. 24 is a front view illustrating a state where an arm of a hanger according to an application example of the fourth embodiment is open.
Figure 25:
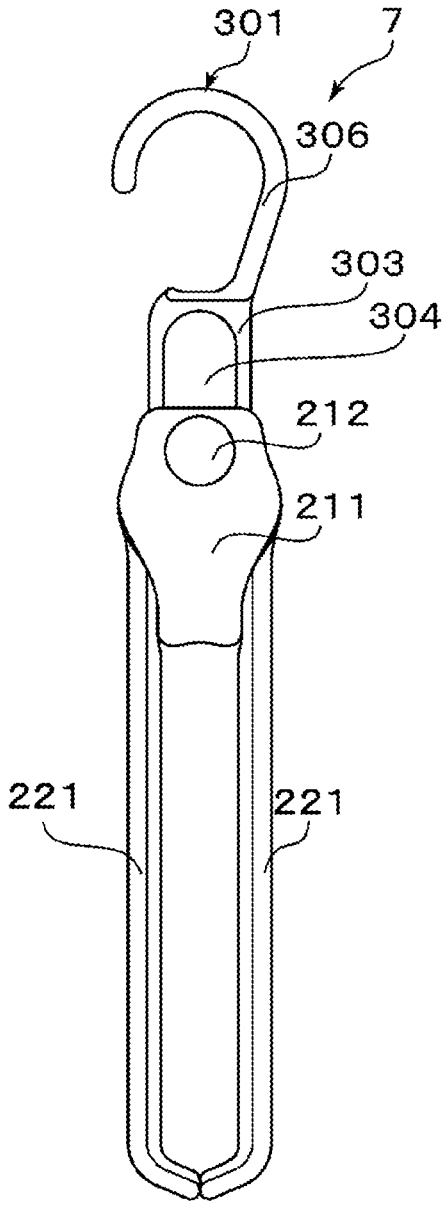
FIG. 25 is a front view illustrating a state where the arm of the hanger according to the application example of the fourth embodiment is closed.
Figure 26:
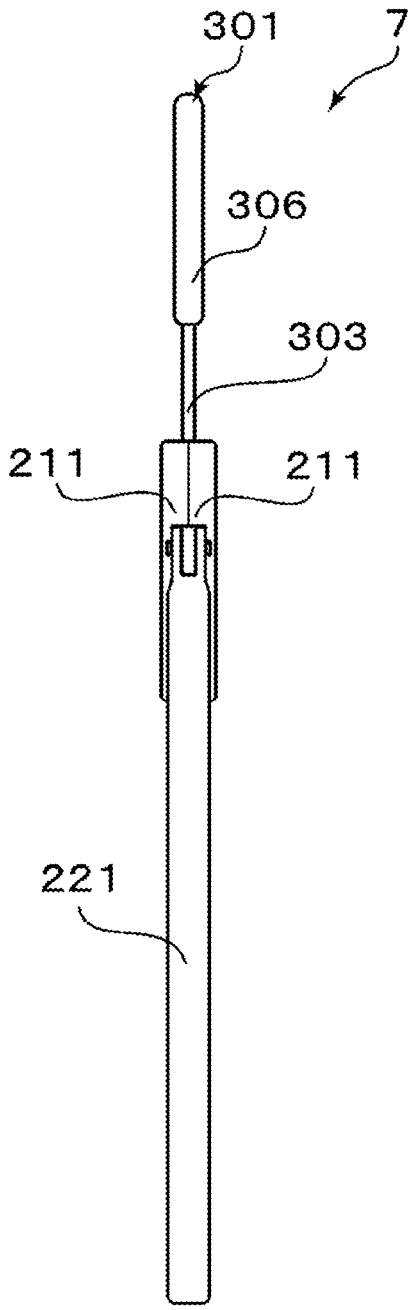
FIG. 26 is a right side view illustrating a state where the arm of the hanger according to the application example of the fourth embodiment is closed.

FIG. 24 is a front view illustrating a state where the arm 221 of a hanger 7 according to an application example of the fourth embodiment is open, FIG. 25 is a front view illustrating a state where the arm 221 of the hanger 7 according to the present application example is closed, and FIG. 26 is a right side view illustrating a state where the arm 221 of the hanger 7 according to the present application example is closed.

As illustrated in FIGS. 24 to 26, the hanger 7 of the present embodiment is provided with a legged hook portion 301, the pair of main body portions 211, and the pair of arms 221 (the vertical, right-left, longitudinal, and lateral directions in the following description are based on the front view in FIG. 12).

The configuration of the hanger 7 according to the present application example is different from the configuration of the hanger 6 according to the fourth embodiment only in that the hook portion 201 is replaced with the legged hook portion 301. The hanger 7 and the hanger 6 according to the fourth embodiment are identical to each other as to the rest of the configurations. Accordingly, only the legged hook portion 301 will be described below.

Figure 27:
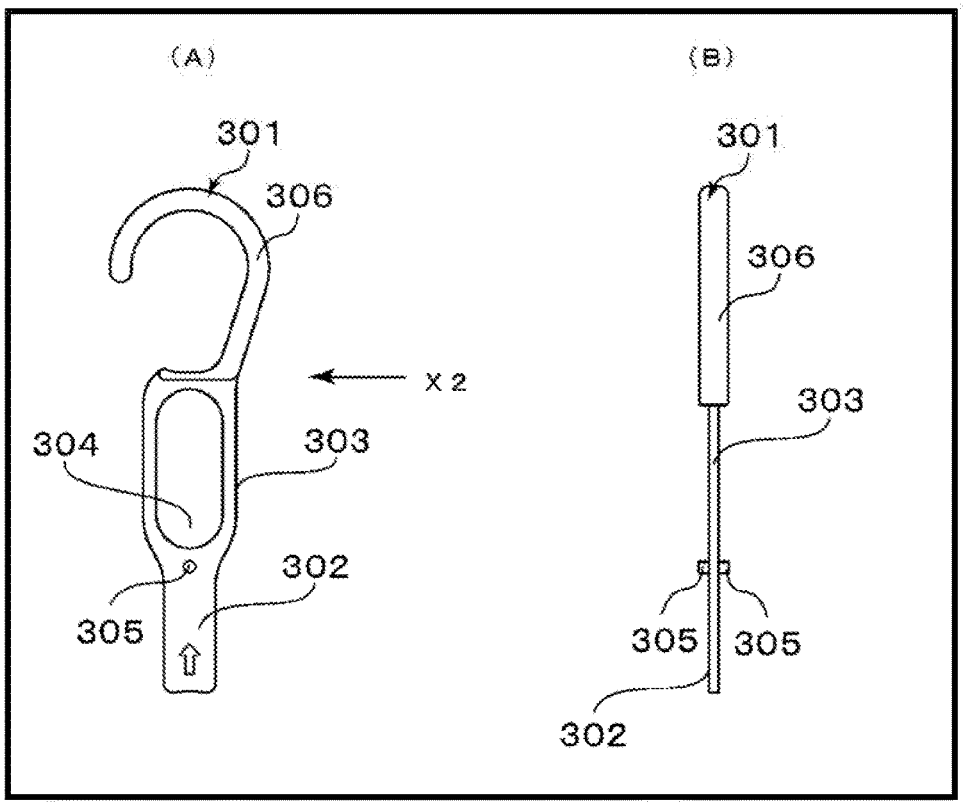
FIG. 27 is a diagram illustrating a legged hook portion.

FIG. 27 is a diagram illustrating the legged hook portion 301. FIG. 27(A) is a front view of the legged hook portion 301 and FIG. 27 (B) is an X2 arrow view of the legged hook portion 301.

As illustrated in FIG. 27, the legged hook portion 301 is provided with a hook 306, an operating portion 303, and a leg portion 302. The operating portion 303 is disposed below the hook 306 and has a long hole 304 and main pins 305. The long hole 304 is large enough to pass a finger. The main pins 305 are disposed below the long hole 304. The protruding main pins 305 are respectively provided on the front and back of the operating portion 303. The leg portion 302 is disposed below the main pins 305 and extends downward.

The legged hook portion 301 is formed separately from the main body portion 211.

Next, a method for assembling the hanger 7 will be described. First, one arm 221 is placed onto one main body portion 211 in such a way that the side pin 222 fits into the side groove portion 213B.

Next, the legged hook portion 301 is placed in such a way that the main pin 305 fits into the main pin hole 225 and the main groove portion 213A.

Next, the other arm 221 is placed in such a way that the side pin 222 fits into the other side groove portion 213B and the main pin 305 fits into the main pin hole 225.

Lastly, the other main body portion 211 is placed in such a way that the main pin 305 fits into the main groove portion 213A and the side pin 222 fits into the side groove portion 213B and the fitting portions 214 are fitted to each other.

Figure 28:
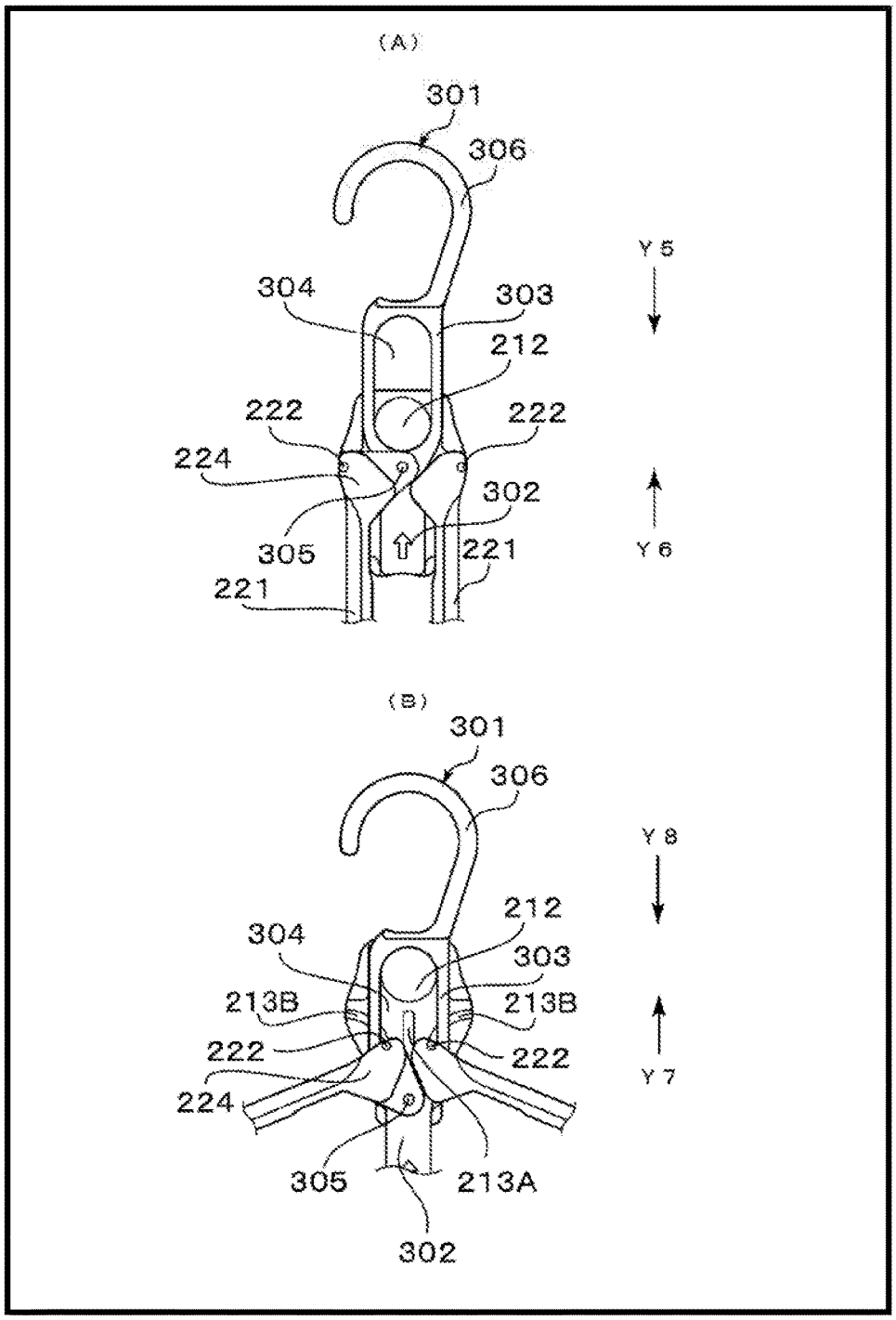
FIG. 28 is a diagram illustrating how the arm of the hanger according to the application example of the fourth embodiment is opened and closed.

FIG. 28 is a diagram illustrating how the arm 221 of the hanger 7 is opened and closed. Illustrated in FIG. 28 is a state where the main body portion 211 on the front side is removed. FIG. 28 (A) illustrates a state where the arm 221 is closed and FIG. 28(B) illustrates a state where the arm 221 is open.

For the state of the arm 221 to be changed from the closed state to the open state, a finger is inserted into the second finger hole 212, another finger is put onto the upper surface of the lower end portion of the hook 306, the upper surface of the lower end portion of the hook 306 is pressed in the direction of an arrow Y5, the upper portion of the second finger hole 212 is pressed in the direction of an arrow Y6, and then the upper surface and the upper portion are brought close to each other.

As a result of the pressing described above, the main pin 305 moves downward from above in the main groove portion 213A and the side pin 222 moves downward from above in the side groove portion 213B.

The distance between the side pins 222 decreases and the state of the pair of arms 221 is changed from the closed state to the open state. The side groove portion 213B curves, and thus it is possible to open the arm 221 smoothly, with one hand, and by a single operation (with one touch) at this time.

For the state of the arm 221 to be changed from the open state to the closed state, a finger is put at the lower end of the leg portion 302, another finger is inserted into the second finger hole 212, the leg portion 302 is pressed in the direction of an arrow Y7, the bottom portion of the second finger hole 212 is pressed in the direction of an arrow Y8, and then the leg portion 302 and the bottom portion are brought close to each other.

As a result of the pressing described above, the main pin 305 moves upward from below in the main groove portion 213A and the side pin 222 moves upward from below in the side groove portion 213B.

The distance between the side pins 222 increases and the state of the pair of arms 221 is changed from the open state to the closed state. The side groove portion 213B curves, and thus it is possible to close the arm 221 smoothly, with one hand, and by a single operation (with one touch) at this time.

And the present application example has an effect that the opening and closing operation is further facilitated since a finger-pinching operation may be applied to both opening and closing of the arm 221.

It should be noted that the upper end portion of the main slit (14A, 43B, 71, 121) may not be at the same height as the upper end portion of the side slit (14B, 43A, 72, 122) and the upper end portion of the main groove portion 213A may not be at the same height as the upper end portion of the side groove portion 213B in each of the embodiments.

Lastly, the material of the hanger 6 and the hanger 7 will be described. The material of the hanger 6 and the hanger 7 is not limited insofar as the material has sufficient strength to hang clothing. For example, one or more materials selected from resin, metal, wood, and paper can be used as the material. In particular, an effect that recycling is possible is achieved with regard to a part using paper.

It should be noted that another embodiment is identical in material to the present embodiment.

As described above, the hanger 6 of the present embodiment is provided with the hook 206 having the first finger hole 202 large enough to pass a finger in the lower portion thereof, the operating portion 203 having the long hole 204 disposed below the first finger hole 202 and large enough to pass a finger and the pair of front and rear main pins 205 disposed below the long hole 204, the main body portions 211 formed separately from the operating portion 203 and in the shape of a pair of plates and having in the upper portion thereof the second finger hole 212 large enough to pass a finger, the main groove portion 213A which is disposed below the second finger hole 212, which extends in the vertical direction, and into which the main pin 205 fits, and the pair of side groove portions 213B which are provided on both sides of the main groove portion 213A, extend toward the main groove portion 213A, change to the downward orientation while curving ahead of the main groove portion 213A, and then extend along the main groove portion 213A, and the pair of arms 221 provided with the base portions 224 having the main pin holes 225 through which the main pin 205 is inserted in the vicinity of the distal ends of the bases and the pair of side pins 222 provided in the base portions 224 and fitted into the side groove portions 213B.

Achieved as a result is an effect that it is possible to provide a hanger with which the arm 80 can be more easily opened and closed with one hand and one touch and clothing can be easily attached and detached.

In addition, the operating portion 203 and the base portion 224 are accommodated inside the pair of main body portions 211, and thus an effect is achieved that it is possible to prevent finger pinching or dust accumulation.

REFERENCE SIGNS LIST

1 Hanger
2 Hanger
3 Hanger
4 Hanger
5 Hanger
6 Hanger
11 Arm
11A Main hole
11B Side hole
11K Bent portion
12 Main pin
12A Main washer
12B Main nut
13 Hook
14 Main body portion
14A Main slit
14B Side slit
15 Side pin
15A Side washer
15B Side nut
30 Operating portion
31 Hook
32 Branching portion
33 Pin
33A Insertion hole
34 Knob
35 Projecting portion
41 Main body portion
42 First handle
43A Side slit
43B Main slit
44 Second handle
51 Arm
52 Movement pin
53 Base portion
54 Pin hole
60 Hook portion
61 Hook
62 Operating portion
63 Insertion hole
64 Side pin
70 Main body portion
71 Main slit
72 Side slit
73 Insertion hole
80 Arm
81 Main pin
82 Base portion
83 Side pin hole
84 Main pin hole
90 Hook portion
91 Hook
92 Operating portion
95 First finger hole
96 Insertion hole
97 First finger hook portion
98 Second finger hook portion
110 Arm
112 Base portion
113 Side pin
114 Main pin hole
120 Main body portion
121 Main slit
122 Side slit
123 First handle
125 Second finger hole
201 Hook portion
202 First finger hole
203 Operating portion
204 Long hole
205 Main pin
206 Hook
211 Main body portion
212 Second finger hole
213A Main groove portion
213B Side groove portion
214 Fitting portion
221 Arm
221A Cross section
222 Side pin
223 Groove portion
224 Base portion
225 Main pin hole
301 Hook portion
302 Leg portion
303 Operating portion
304 Long hole
305 Main pin
306 Hook

The invention claimed is:

1. A hanger comprising:

a hook;

an operating portion provided with a branching portion which is disposed at a base of the hook and which is divided into a fork to a front side and a rear side in a front view, knobs each having an insertion hole in a central part thereof and disposed at lower ends of the branching portion, and a pair of projecting portions provided on opposing surfaces of the knobs;

a main body portion including a main slit which extends in a vertical direction and into which the projecting portions fit, and a pair of side slits which are provided on both sides of the main slit, extend toward the main slit, change to a downward orientation while curving ahead of the main slit, and then extend along the main slit;

a pair of arms each provided with a base portion having a pin hole in a vicinity of a distal end of a base, and a movement pin which is provided in the base portion and which is inserted through the corresponding side slit; and a pin inserted through the insertion holes and the pin holes.

2. The hanger according to claim 1, wherein the side slits are opened at both side edges of the main body portion.

3. The hanger according to claim 1, including paper as a material.

4. A hanger comprising:

a hook;

an operating portion extending downward from a base of the hook and provided with an insertion hole in a lower end portion thereof;

a pair of main body portions interconnected in upper end portions thereof and each provided with a main slit which extends in a vertical direction, and a pair of side slits which extend toward the main slit from both sides of the main slit, change to a downward orientation while curving ahead of the main slit, and then extend along the main slit;

a pair of arms each provided with a base portion having a main pin hole in a vicinity of a distal end of a base, and provided with a pair of side pins which are provided in the base portions and which are inserted through the corresponding side slits; and a main pin inserted through the insertion hole, the main slit, and the main pin hole.

5. The hanger according to claim 4, wherein the side slits are opened at both side edges of the main body portion.

6. The hanger according to claim 4, including paper as a material.

7. A hanger comprising:

a hook;

an operating portion extending downward from a base, of the hook and provided with an Insertion hole in, a lower end portion thereof;

a main body portion formed separately from the operating portion and in a single plate shape and including a main slit which extends in a vertical direction, and a pair of side slits which are provided on both sides of the main slit, extend toward the main slit, change to a downward orientation while curving ahead of the main slit, and then extend along the main slit;

a pair of arms each provided with a base portion having a main pin hole in a vicinity of a distal end of a base, and provided with a pair of side pins which are provided in the base portions and which are inserted through the corresponding side slits; and a main pin inserted through the insertion hole, the main slit, and the main pin hole.

8. The hanger according to claim 7, wherein the operating portion further includes a first firmer hole above the insertion hole and the first finger hole has a breadth enough for finger insertion and a longitudinal width equal to or longer than a vertical length of the main slit, and the main body portion further includes a second finger, hole above the main slit and the second finger hole is large enough for finger insertion.

9. The hanger according to claim 7, wherein the side slits are opened at, both side edges of the main body portion.

10. The hanger according to claim 8, wherein the side slits are opened at both side edges of the main body portion.

11. The hanger according to claim 7, including paper as a material.

12. The hanger according to claim 8, including paper as a material.

13. A hanger comprising:

a hook having in a lower portion thereof a first finger hole large enough to pass a finger;

an operating portion provided with a long hole disposed below the first finger hole and large enough to pass a finger and a pair of front and rear main pins disposed below the long hole;

a main body portion formed separately from the operating portion and in a shape of a pair of plates and including a second finger hole large enough to pass a finger in an upper portion thereof, a main groove portion which is disposed below the second finger hole, which extends in a vertical direction, and into which the main pin fits, and a pair of side groove portions which are provided on both sides of the main groove portion, extend toward the main groove portion, change to a downward orientation while curving ahead of the main groove portion, and then extend along the main groove portion; and a pair of arms each provided with a base portion having a main pin hole through which the main pin is inserted in a vicinity of a distal end of a base, and provided with a pair of side pins which are provided in the base portions and which are fitted into the corresponding side groove portion.

14. The hanger according to claim 13, including paper as a material.

15. A hanger comprising:

a hook;

an operating portion disposed below the hook and provided with a long hole large enough to pass a finger, a pair of front and rear main pins disposed below the long hole, and a leg portion disposed below the main pin and extending downward;

a main body portion formed separately from the operating portion and in a shape of a pair of plates and including a finger hole large enough to pass a finger in an upper portion thereof, a main groove portion which is disposed below the finger hole, which extends in a vertical direction, and into which the main pin fits, and a pair of side groove portions which are provided on both sides of the main groove portion, extend toward the main groove portion, change to a downward orientation while curving ahead of the main groove portion, and then extend along the main groove portion; and a pair of arms each provided with a base portion having a main pin hole through which the main pin is inserted in a vicinity of a distal end of a base, and provided with a pair of side pins which are provided in the base portions and which are fitted into the corresponding side groove portions.

16. The hanger according to claim 15, including paper as a material.

* * * * *